United States Patent [19]

Kubo et al.

[11] Patent Number: 5,014,092

[45] Date of Patent: May 7, 1991

[54] IMAGE FORMING APPARATUS WITH A BINDING FUNCTION

[75] Inventors: Naoki Kubo; Takuma Ishikawa; Toshio Matsui; Fumitoshi Atsumi; Yasuhiko Doi, all of Osaka, Japan

[73] Assignee: Minolta Camera Co., Ltd., Osaka, Japan

[21] Appl. No.: 360,239

[22] Filed: Jun. 1, 1989

[30] Foreign Application Priority Data

| | | | |
|---|---|---|---|
| Jun. 4, 1988 | [JP] | Japan | 63-137933 |
| Jun. 4, 1988 | [JP] | Japan | 63-137934 |
| Jun. 4, 1988 | [JP] | Japan | 63-137935 |
| Jun. 14, 1988 | [JP] | Japan | 63-147159 |
| Nov. 11, 1988 | [JP] | Japan | 63-286110 |
| Nov. 11, 1988 | [JP] | Japan | 63-286111 |

[51] Int. Cl.[5] ..... G03G 15/00

[52] U.S. Cl. ..... 355/324; 355/218; 355/245; 355/295

[58] Field of Search ..... 355/218, 245, 295, 324, 355/325; 118/653; 156/150, 151, 279, 283, 291; 281/21 R

[56] References Cited

U.S. PATENT DOCUMENTS

| | | | |
|---|---|---|---|
| 3,793,016 | 2/1974 | Eichorn | 355/218 X |
| 3,794,550 | 8/1972 | Taillie | 161/147 |
| 4,511,297 | 4/1985 | Wilson et al. | 355/324 X |
| 4,540,458 | 9/1985 | Baughman et al. | 355/324 X |
| 4,797,048 | 1/1989 | Doery | 355/324 X |

FOREIGN PATENT DOCUMENTS 62-98371 5/1987 Japan .

*Primary Examiner*—R. L. Moses

*Attorney, Agent, or Firm*—Willian, Brinks, Olds, Hofer, Gilson & Lione

[57] ABSTRACT

An image forming apparatus with a binding function wherein small bands of toner are deposited on paper sheets, a plurality of said sheets are then stacked and thereafter said small bands of deposited toner are fused, thereby binding said sheets.

In order to form said small bands of toner on an electrostatic latent image carrier, the present invention is provided with a charger disposed between an exposure position and the developing position so as to be movable perpendicularly to the paper transport direction, an optical shutter disposed in the image exposure optical path and selectably operable, or a scale disposed at one side of a platen glass for preventing light from reaching the image carrier.

Said small band of toner formed on the image carrier may be developed by a special toner such as waste toner removed from the surface of the image carrier after being supplied to copy the original document image, white toner, color toner, or highly self-adhesive toner.

The apparatus may further comprises controller for controlling the apparatus so as not to form the binding toner on a suitable cover sheet of the sheet stack.

The width of the binding toner deposited on the sheet may be controlled so as to be variable by changing the timing for transporting sheets toward a transfer station.

17 Claims, 36 Drawing Sheets

IMAGE FORMING APPARATUS WITH A BINDING FUNCTION

BACKGROUND OF THE INVENTION

1. Field of the Invention

The present invention relates to an image forming apparatus for forming toner images on paper by an electrophotographic process, and more specifically relates to an image forming apparatus having a binding function whereby small bands of toner are deposited on paper sheets, a plurality of said sheets are then stacked and thereafter said small bands of deposited toner are fused, thereby binding said sheets.

2. Description of the Related Arts

A demand for a binding function to bind the sheets bearing toner images to produce the final product has accompanied the systematization of copy machines in recent years. Conventional stapling, clipping and gluing means have been developed as forms of this type of binding technology. A method using toner as an adhesive medium is desirable because it eliminates the disadvantage of requiring a special device for the staple, clip, glue or other medium (refer to Japanese Patent Application Nos. 49-133039 and 62-98371).

However, a copy machine having a toner binding system which is easy to use has yet to be developed.

SUMMARY OF THE INVENTION

A main object of the present invention is to provide an image forming apparatus capable of simply and reliably binding paper sheets using toner as the adhesive medium.

Another object of the present invention is to provide an image forming apparatus capable of binding paper sheets on a side parallel to the paper transport direction and on a side perpendicular to said transport direction.

Still another object of the invention is to provide an image forming apparatus capable of reducing running cost or acheiving reliable binding by using a special toner.

A further object of the present invention is to provide an image forming apparatus capable of permanent and temporary binding by varying the width of the deposited binding toner.

A still further object of the invention is to provide an image forming apparatus that is controllable so that binding toner is not deposited on the paper suitable for use as a cover sheet.

To accomplish the aforesaid objects, the present invention forms a region of electric potential to deposit a small band of toner on the surface of an electrostatic latent image carrier, and after toner is deposited in the region of potential on a plurality of sheets, said sheets are fused using a sheet binding means.

More specifically, a region of electrical potential can be formed on the surface of an electrostatic latent image carrier to deposit a small band of toner thereon by providing between the image exposure position and the developing position a charge imparting means which is movable perpendicularly to the paper transport direction.

Alternatively, the region of electric potential for depositing a small band of toner on the surface of an electrostatic latent image carrier may be formed by providing a shutter means in the image exposure optical path, and selectably controlling the ON/OFF status of individual elements of said shutter means.

Alternatively, the region of electric potential for depositing a small band of toner on the surface of an electrostatic latent image carrier may be formed by providing at the document glass platen exposure starting position a movable auxiliary document scale having on one surface a nonreflective process section.

Alternatively, the region of electric potential for depositing a small band of toner on the surface of an electrostatic latent image carrier may be formed by providing on the upstream side of the image exposure starting position a document scale having a nonreflective process section on the reverse surface thereof.

Viewing the present invention from another perspective, the region of electric potential formed on the surface of an electrostatic latent image carrier can be developed using a special toner to transfer the document image to the copy paper.

The special toner used for binding may be, for example, waste toner removed from the surface of the electrostatic latent image carrier by a cleaning means after being supplied to copy the original document image, white toner, color toner, or highly self-adhesive toner and the like. These toners may be supplied to a developing device separate from the developing device used to develop the original document image, and applied therefrom to the electrostatic latent image.

Viewing the present invention from still another perspective, sheet binding may be controlled so as to not deposit binding toner on a suitable cover sheet on the sheet stack. Paper suitable for use as a cover sheet may be the sheet used as the first page (upon which is formed the original document image), or the image forming process may be halted while continuing transport of the copy paper only so that the sheet is discharged from the image forming section (the original document image is not formed on this sheet).

Viewing the present invention from still another perspective, the width of the binding toner deposited on the sheet may be controlled so as to be variable by changing rotational timing of the timing roller.

These and other object, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIGS. 1 through 16 show the first embodiment of the image forming apparatus of the present invention. FIG. 1 is a brief structural view of copy machine and paper binding device. FIG. 2 is a top plan view of the copy machine. FIG. 3 is an illustration to explain the scanning process of the optical unit. FIG. 4 is a perspective view of the waste toner recycle system. FIG. 5 is a section view showing the construction on the periphery of the photoreceptor drum. FIG. 6 is a horizontal sectional view of the developing device. FIG. 7 is a section view showing the developing device during operation. FIG. 8 is a side elevation view of the developing device during operation. FIG. 9 is a section view showing the developing device when not operating. FIG. 10 is a side view of the developing device when not operating. FIG. 11 is a time chart. FIG. 13 is a plan view of the control panel. FIG. 14 is a block diagram of the control circuit. FIGS. 15, 16*a* and 16*b* are flow charts showing the control sequences.

FIG. 17 is an illustration of the vicinity of the image exposure starting position. FIG. 18 is a brief structural view of the image forming means. FIG. 19 is an illustration of the essential portion of a further embodiment. FIGS. 20 through 36 show a third embodiment of the image forming apparatus of the present invention. FIG. 20 is a brief structural view of a copy machine provided an automatic document feeder (ADF) and the paper binding device. FIG. 21 is a brief structural view of the image forming means. FIG. 22 is a circuit diagram of the power source for the scorotron charger. FIG. 23 is an elevation view of the scorotron charger moving means. FIG. 24 is a top plan view of the paper sheet showing the deposited binder toner. FIGS. 27*a*, 27*b*, 28, 29*a*, 29*b* and 29*c* are flow charts showing control sequences for the first example of the copy machine. FIGS. 30, 31, 32, 33 and 34 are flow charts showing the ADF control sequences of the first example. FIGS. 35*a*, 35*b* and 36 are flow charts showing the second mode copy machine control sequences of a second example. FIG. 38 is an illustration of the vicinity of the image exposure starting position. FIG. 39 is a time chart showing the rotational timing of the timing roller. FIG. 40 is a flow chart showing the control sequence.

DETAILED DESCRIPTION OF THE PREFERRED EMBODIMENTS

The preferred embodiments of the image forming apparatus of the present invention are described hereinafter with reference to the accompanying drawings.

First Embodiment

Figure 1:
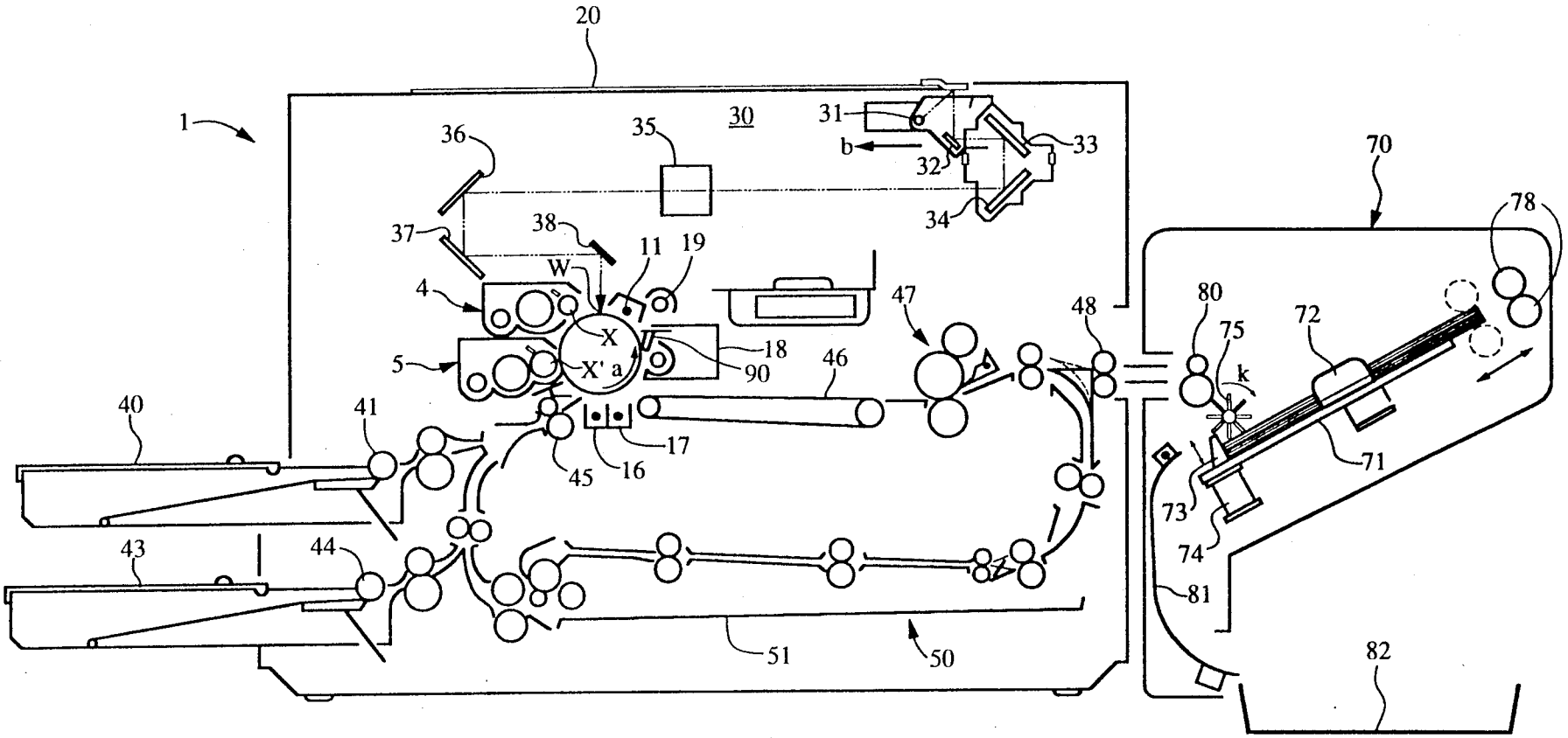

In FIG. 1, a photoreceptor drum 10 which is rotatably drivable in the direction of arrow "a" is provided in the center of copy machine 1. The surface of photoreceptor drum 10 is provided a common photoconductive layer, and arranged around the circumference of said drum 10 in the direction of rotation are a charger 11, first developing device 5, transfer charger 16, separation charger 17, residual toner cleaning device 18, and residual charge eraser lamp 19.

Optical system 30 comprises an exposure lamp 31, movable mirrors 32, 33 and 34, image forming lens 35, and stationary mirrors 36, 37 and 38. Exposure lamp 31 and movable mirror 32 move as a unit at a speed of V/m (where V is the circumferential speed of the photoreceptor drum, and m is the copy magnification), and movable mirrors 33 and 34 move as a unit at a speed of V/2m, both units moving in the direction of arrow b. The original document is placed on the document glass platen 20, and the image is exposed through a slit at the exposure section W by moving optical system 30 in the direction of the aforesaid arrow b.

On the other hand, copy paper is fed a single sheet at a time from either automatic feed cassettes 40 or 43 based on the rotation of paper take-up rollers 41 and 44, and transported to the transfer section synchronously with the image formed on photoreceptor drum 10 by timing roller 45. Following transfer of the image to the copy paper, the sheet is transported to the fixing device 47 by a transport belt 46 provided with an air suction means not shown in the drawings, and after the toner is fixed, said sheet is discharged from the copy machine 1 by discharge roller set 48.

Each cassette installation is provided a sheet size detecting sensor not shown in the drawings, such that operating mode of said sensors are changeable by the arrangement and position of a protuberance or magnet or the like corresponding to the size of the sheets contained in the installed cassette, so that the paper size can be discriminated by means of a specific code.

In addition, a sheet re-feed unit 50 is provided in the interior of copy machine 1 for duplex and composite copies.

When making duplex copies, the copy paper is first inverted so that the image bearing surface of the sheet is facing downward, and then deposited in intermediate tray 51. When making composite copies, the copy paper is first deposited in intermediate tray 51 so that the image bearing surface faces upward. When a sheet re-feed signal is output, sheets are re-fed from intermediate tray 51 one sheet at a time and transported to the aforesaid timing roller set 45.

Forming Binding (Waste) Toner and Document Images

Figure 2:
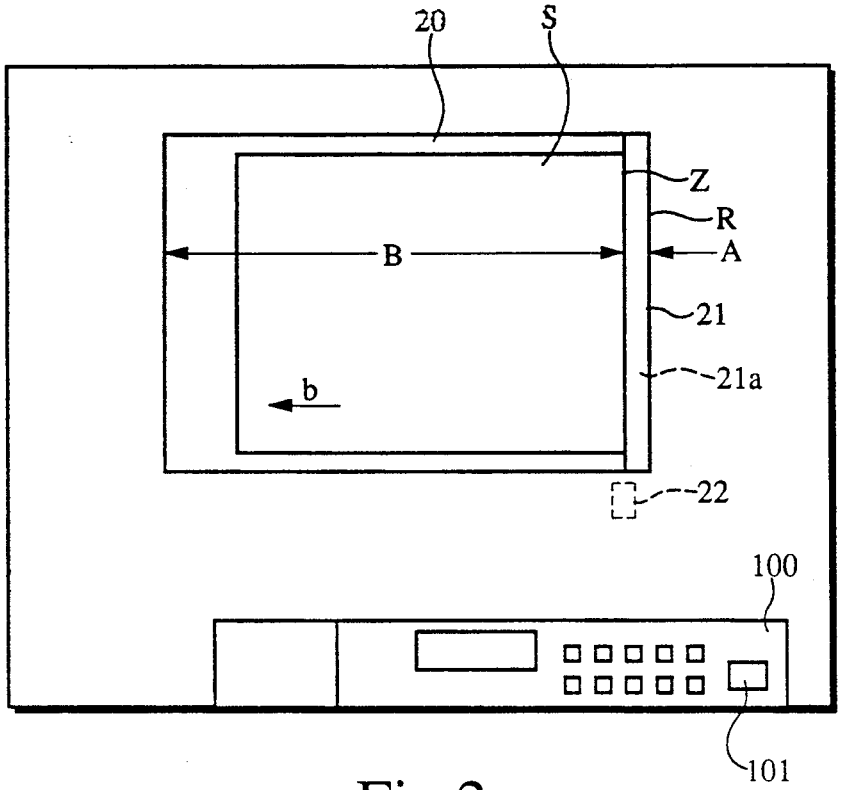
Figure 3:
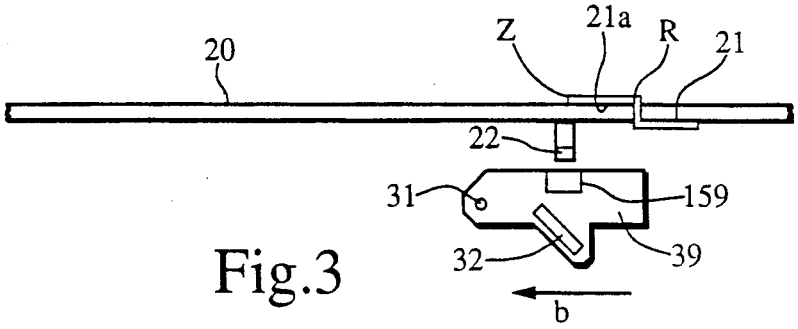

The copy machine is provided a document scale 21 on one side of document glass platen 20, as shown in FIGS. 2 and 3. The reverse side of the document scale 21 is provided a nonreflective or non-specular process the entire length of section 21*a* positioned on an edge of document glass platen 20 (for example, a black coating or mirror process). Original document S is positioned at the edge Z of document scale 21 on glass platen 20, and scanning of said document S starts from region R with the movement of exposure lamp 31 in the direction of arrow b. Region A shown in FIG. 2 is equivalent to the nonreflective or non-specular region 21*a* extending from the scan starting line R to document position line Z. Region B is the document image forming region extending from document position line Z to the edge of glass platen 20 in the scan direction.

Exposure lamp 31 begins to move from the home position slightly to the right of the solid line position in FIG. 3. First, the nonreflective/non-specular region 21*a* of region A is exposed, the exposure light is absorbed and does not reach the photoreceptor drum 10, and the surface potential of the photoreceptor drum charged by charger 11 remains high such that a band-like high potential region remains in the axial direction of the drum. Then, the aforesaid high potential region is developed by waste toner by passing the developing region X of first developing device 4, as described hereinafter. On the other hand, the image on the document placed in region B is formed as an electrostatic latent image on photoreceptor drum 10 by moving optical unit 30, said electrostatic latent image is then developed by black toner as it passes developing region X' of second developing device 5.

A magnet 22 is disposed within the machine at the boundary of the aforesaid regions A and B, i.e., at the document position line Z. In addition, the slider 39 which maintains exposure lamp 31 and mirror 32 of optical unit 30 is provided a reed switch 159. Reed switch 159 is switched ON and OFF by magnet 22 each time optical unit 30 scans in the direction of arrow b. The set point of reed switch 159 corresponds to the document surface exposure position of exposure lamp 31, and switching the exposure position from region A to region B is detected when said reed switch is switched ON by magnet 22.

Developing Device Construction

Descriptions of developing devices 4 and 5 follow hereinafter.

Figure 4:
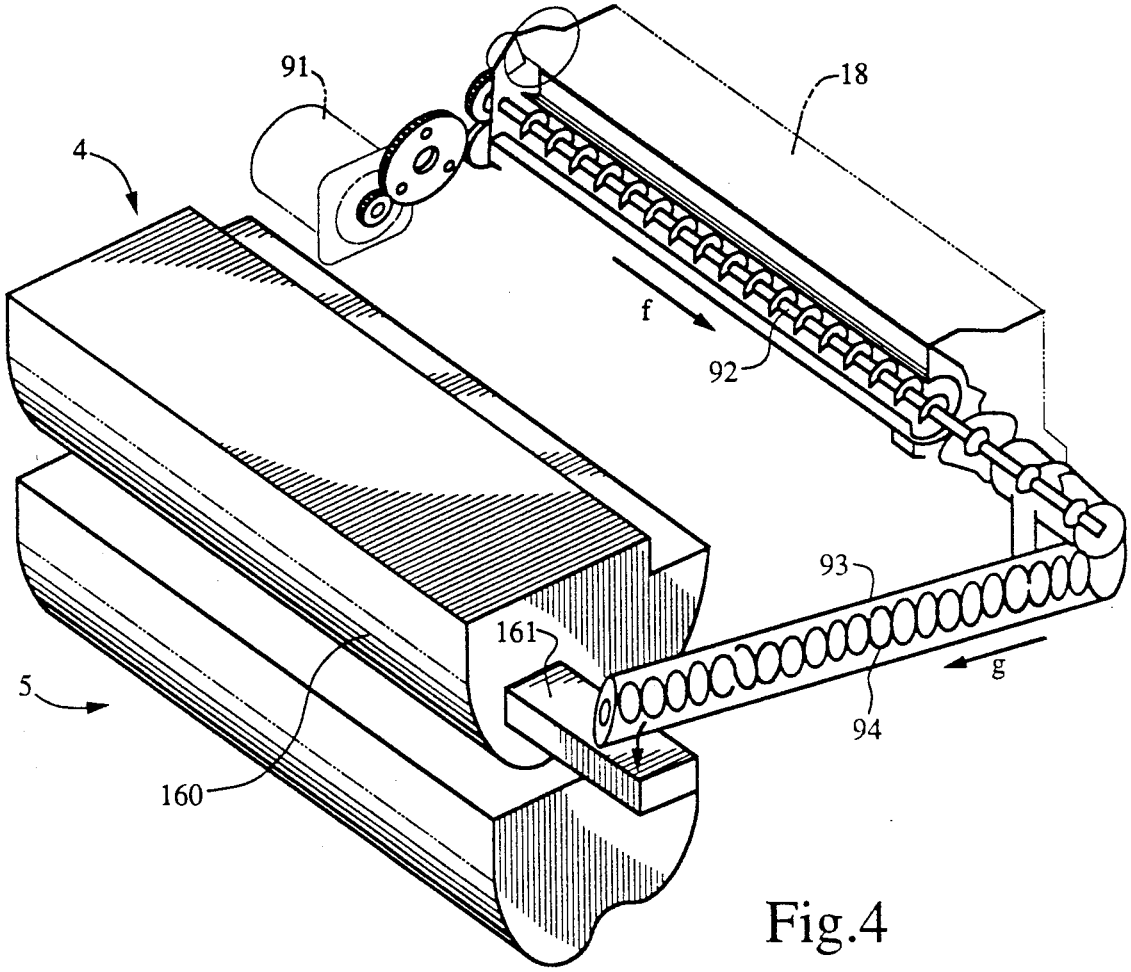

First developing device 4 develops to bind the sheet by using waste toner as the developing material. Waste toner is the residual toner scraped from the surface of photoreceptor drum 10 by blade 90 of cleaning unit 18. Cleaning unit 18 is provided a spiral roller 92 that is rotatably driven by motor 91, as shown in FIG. 4, and the retrieved waste toner is transported in the direction indicated by arrow f by said spiral roller 92. The waste toner discharge portion of spiral roller 92 is connected to one end of recycle pipe 93 disposed within spiral roller 94, and the other end of said pipe 93 confronts box 161 which protrudes developing tank 160 of first developing device 4. The ends of spiral rollers 92 and 94 are linked by a bevel gear not shown in the drawing, so that rotational force can be transmitted from roller 92 to roller 94. Accordingly, waste toner discharged from cleaning device 18 is transported in the direction of arrow g within the recycle pipe 93 by means of the rotation of spiral roller 94, and thereafter delivered from box 161 to the interior of developing tank 160 of first developing device 4.

On the other hand, the second developing unit 5 develops the original document image and is filled with a developing material containing a conventional black toner.

Figure 5:
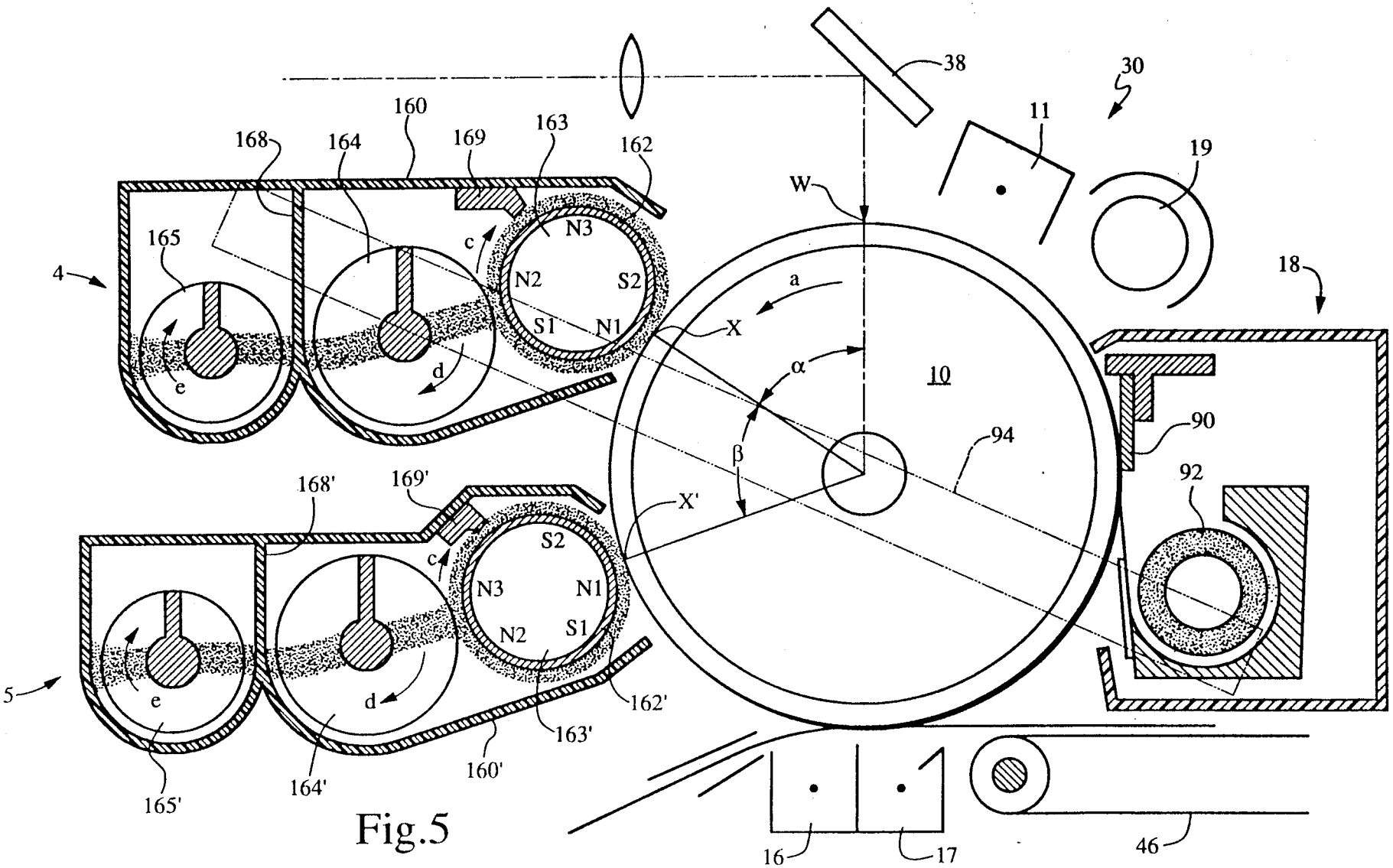

Developing devices 4 and 5 are substantially similar in construction, as shown in FIG. 5, having arranged within a developing tank 160 sequentially from the side of photoreceptor drum 10 a developing sleeve 162, supply roller 164 and screw 165. Although the following description mainly concerns the first developing device 4, the second developing device 5 has identical construction and operation.

Developing sleeve 162 is constructed of nonmagnetic, electrically conductive material formed in a cylindrical shape having a major diameter of 24.5 mm with very small concave and convex portion or undulations on its outer peripheral surface by a sand blasting process, and confronts photoreceptor drum 10 at the developing region X through a uniform developing gap Ds (=0.6 mm), with rotational angles from the exposure point W to the developing regions X and X' being respectively set as $\alpha$ and $(\alpha+\beta)$, wherein $\alpha$ is set at 56° and $\beta$ is set at 52°.

Meanwhile, at the rear surface side of developing sleeve 162 relative to developing region X, a magnetic brush bristle height restricting plate 169 is provided an upper interior portion of developing tank 160 so as to confront the surface of said developing sleeve 162 through a bristle height restricting gap Db (=0.4 mm).

Within developing sleeve 162 is disposed a magnet roller 163 having a plurality of magnets extending in the axial direction, and the magnetic forces of the magnetic poles N1, N2, N3, S1 and S2 located at the outer peripheral faces of said magnets are respectively set as N1=1000 G, N2 and N3=500 G, and S1 and S2=800 G (where G is an abbreviation of a gaussian unit).

Figure 7:
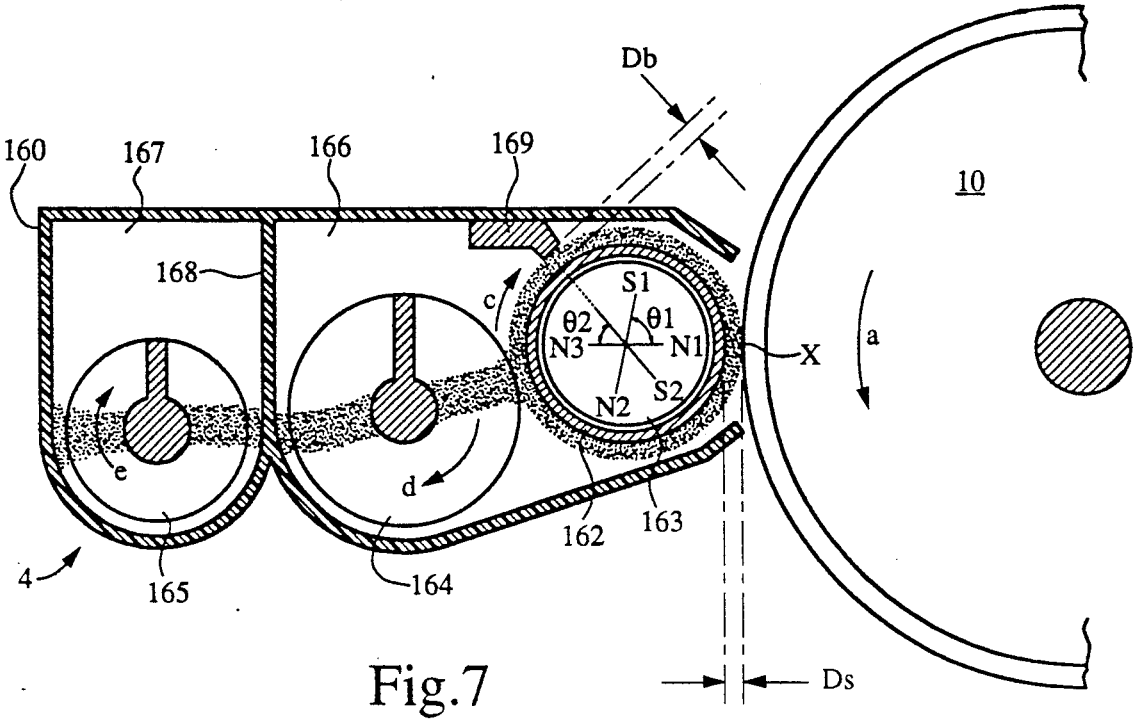

As shown in FIG. 7, the center of magnetic pole N1 is located at a position displaced clockwise from the center of the magnetic pole S1 by $\theta_1$ (80°), while the center of the magnetic pole N3 is adapted to be located at a position displaced counterclockwise from the portion confronting the bristle height restricting member 169 by $\theta_2$ (40°), under the state where the magnetic pole N1 faces the photoreceptor drum 10.

Figure 6:
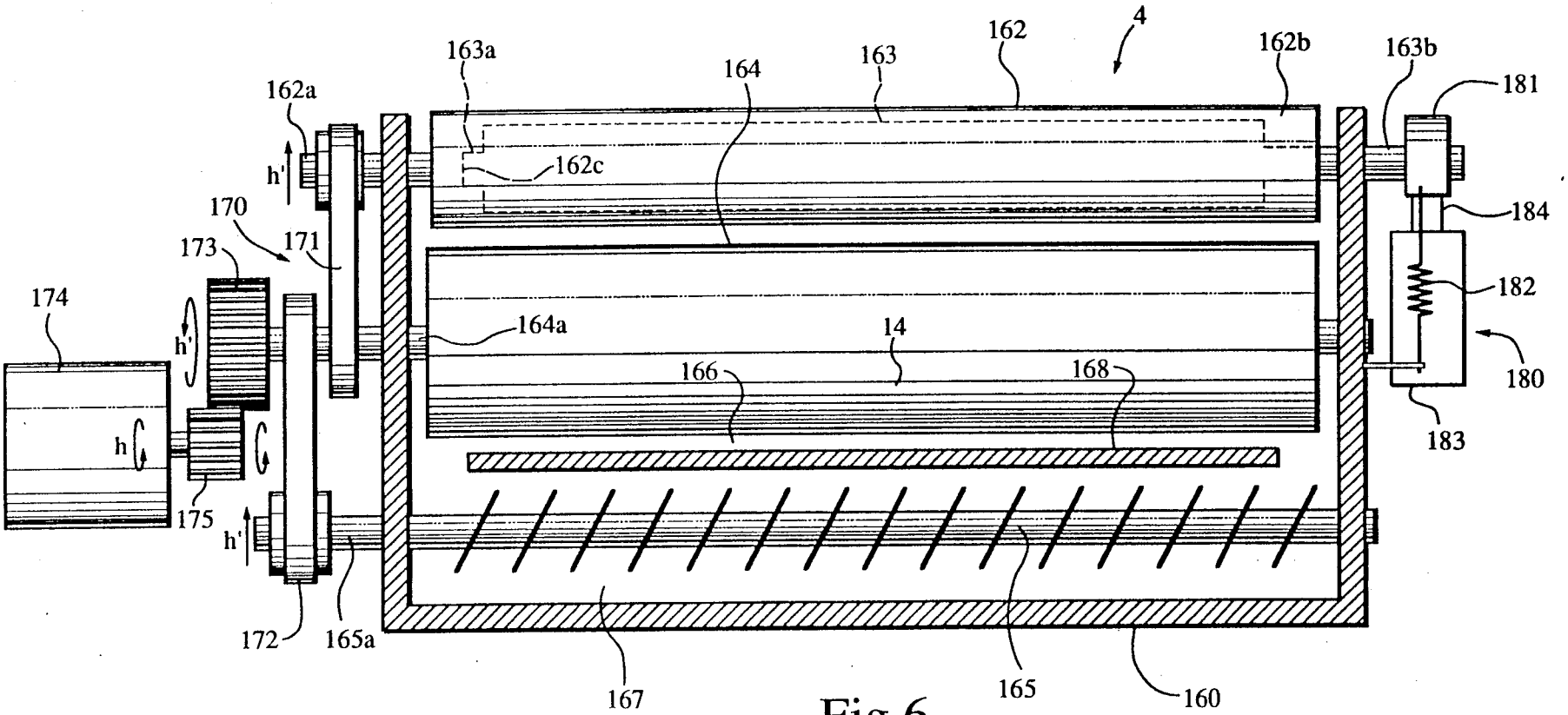

As shown in FIG. 6, magnet roller 163 has one end 163*a* of its shaft supported in a bearing recess 162*c* formed in the developing sleeve 162, and the other end 163*b* thereof is supported by a side wall of developing tank 160 so as to be rotatable through a predetermined angle ($\theta$=40°) by a displacing means 180 described in detail hereinafter.

Meanwhile, developing sleeve 162 has its bearing portion 162*b* at the right side in FIG. 6 supported by the shaft 163*b* of magnet roller 163, with its shaft 162*a* at the left side being supported by the side wall of the developing tank 160 so as to be rotatably driven by a driving means 170.

The supply roller 164 and screw 165 are respectively disposed in the transport passages 166 and 167 which are divided by partition wall 168, said rollers 164 and 165 being rotatably supported through support shafts 164*a* and 165*a* thereof by the corresponding side walls of developing tank 160 so as to be rotatably driven by driving means 170. It is to be noted here that the transport passages 166 and 167 communicate with each other at the opposite sides of developing tank 160, as shown in FIG. 6.

The driving means 170 for the developing sleeve 162, supply roller 164 and screw 165 are hereinafter described.

Still referring to FIG. 6, a belt 171 is passed around shaft 162*a* of the developing sleeve 162 and shaft 164*a* of supply roller 164, while another belt 172 is directed around the shaft 164*a* of supply roller 164 and shaft 165*a* of screw 165. A gear 173 is fixedly mounted on the end of the shaft 164*a* of supply roller 164, and said gear 173 is engaged with a driving gear 175 of motor 174. Accordingly, when the driving gear 175 is rotated by motor 175 in the direction indicated by arrow h, gear 173 and belts 171 and 172 are turned in the direction of arrow h', and thus, developing sleeve 162, supply roller 164 and screw 165 are respectively rotatably driven in the directions indicated by arrows c, d and e. It is to be noted here that the developing sleeve 162 is arranged to be rotated at 240 rpm in this embodiment.

Figure 8:
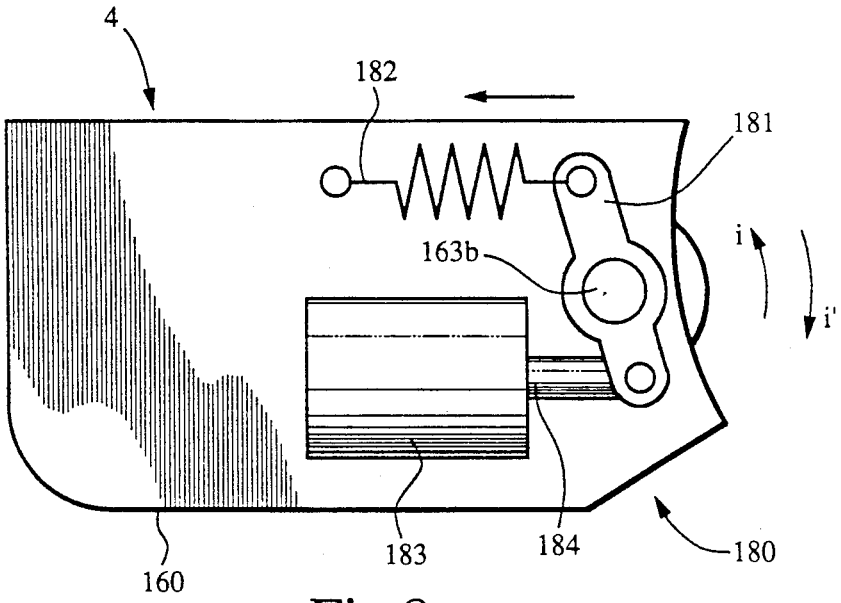
Figure 10:
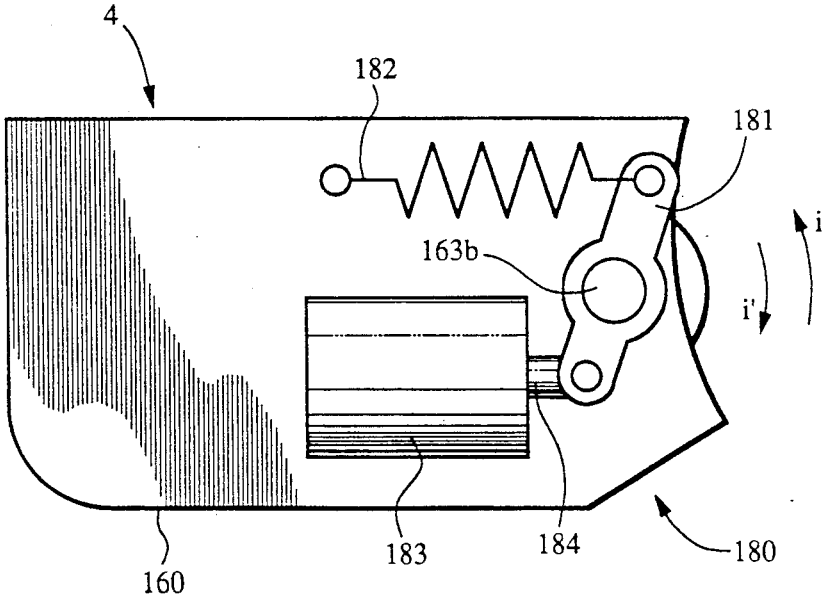

As shown in FIGS. 8 and 10, a displacing means 180 of the magnet roller 163 comprises a lever 181, spring 182 and solenoid 183. Lever 181 is fixedly attached to the end of shaft 163*b* of magnet roller 163, and to one end of said lever 181 corresponding to one end of spring 182 attached to developing tank 160 is connected so as to normally urge said lever 181 in the direction indicated by arrow i. A plunger 184 of solenoid 183 is connected to the other end of the aforesaid lever 181 so that upon the actuation of said solenoid 183, said lever 181 is rotated in the direction of arrow i' against the urging force applied by spring 182.

Figure 9:
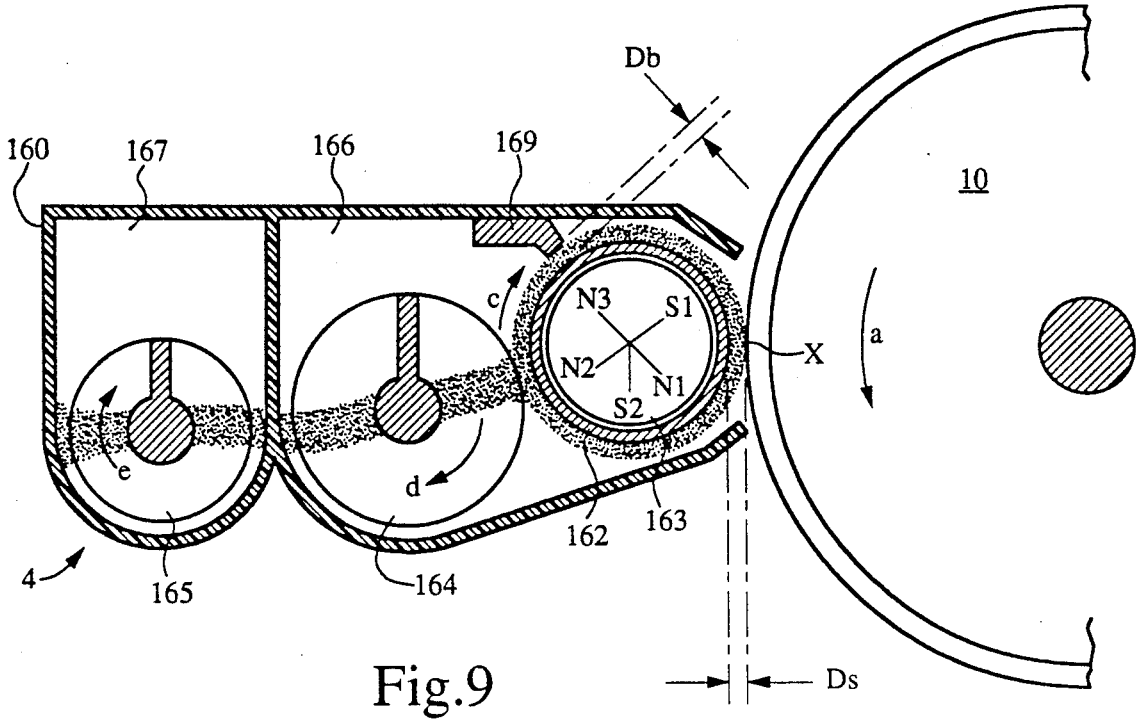

When solenoid 183 is not functioning, i.e., when the lever 181 is in the state illustrated in FIG. 8, the magnetic pole N1 of magnet roller 163 confronts the photoreceptor drum 10, while magnetic pole N3 is retreated to a position displaced counterclockwise by $\theta_2$ (40°) from the confronting portion with respect to the bristle height restricting member 169, as shown in FIG. 7. Conversely, when the solenoid 183 is actuated and lever 181 is in the state shown in FIG. 10, the magnetic pole N3 confronts the bristle height restricting member 169, while an intermediate portion between the magnetic pole N1 and the magnetic pole S1 faces the photoreceptor drum 10, as shown in FIG. 9.

Image Forming Process

Figure 11:
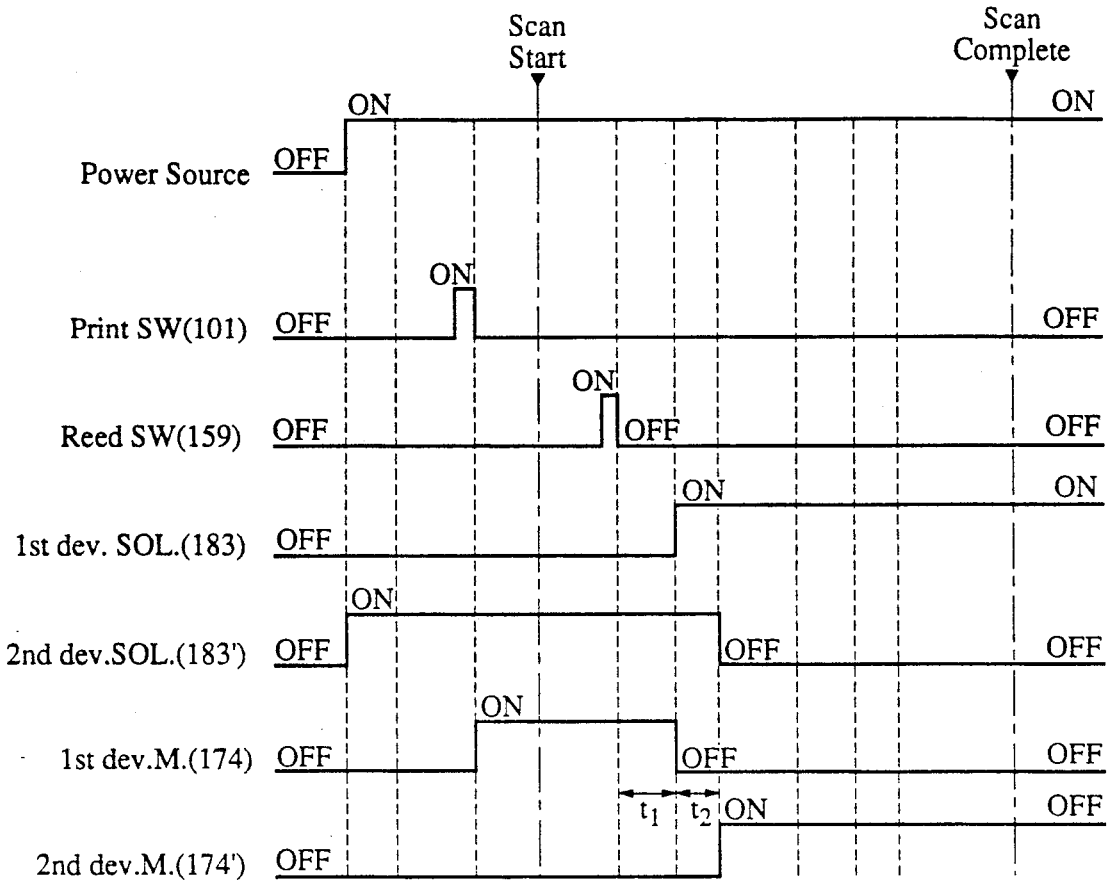

Next, the process wherein the black binder band is formed by waste toner and a document image is formed by black toner in one scan, and transferred to a single sheet is described hereinafter with reference to the FIG. 11 time chart.

First, when the power source is switched ON through operation of the main switch (not shown in the drawings) of copy machine 1, first developing device 4 is capable of developing with solenoid 183 maintained in the OFF state, and magnetic pole N1 confronts photoreceptor drum 10, as shown in FIG. 7. On the other hand, the second developing device 5 is in a non-developing state with solenoid 183' switched ON and the intermediate portion between magnetic poles N1 and S1 confront the photosensitive receptor drum 10, as shown in FIG. 9.

Upon switching ON the print key 101 in the above state with an original document S placed on the document glass platen 20, as shown in FIG. 2, the developing motor 174 of the first developing device 4 is started, and the developing sleeve 162, supply roller 164 and screw 165 are rotatably driven in the directions indicated by arrows c, d and e, respectively. Thus, the developing material containing waste toner accommodated in developing tank 160 is mixed and agitated by the rotation of said supply roller 164 and screw 165, and continuously circulated through transport passages 166 and 167. A portion of the developing material is supplied to the surface of the developing sleeve 162 by supply roller 164 so as to form a magnetic brush above said developing sleeve 162.

The aforesaid magnetic brush is trimmed by bristle height restricting plate 169 as it passes bristle height restricting gap Db by means of the rotation of developing sleeve 162, and is set to be continuously fed out to developing region X so as to be able to develop the electrostatic latent image formed on the photoreceptor drum 10.

Meanwhile, optical system 30 starts to operate in the direction of arrow b based on the ON actuation of print key 101, so as to expose from the region A to region B. When the scan starts, the nonreflective process portion 21*a* on the back of document scale 21 is exposed and the exposure light is absorbed. Accordingly, the reflected light is only projected from the exposure point W to region A so as to form a horizontal band as a high electric potential electrostatic latent image in the axial direction of the drum, and development of said electrostatic latent image is begun by first developing device 4.

Subsequently, when magnet 22 positioned in correspondence to the document position line Z is detected by the reed switch 159 of scanner 39, said reed switch 159 outputs a signal to the control device. At this point in time, the latent image corresponding to a boundary portion Z between regions A and B where change-over is effected from waste toner to black toner, is located at the exposure point W on photoreceptor drum 10, and during time period ($t_1$=0.22 s) wherein the latent image on boundary portion Z is displaced from the exposure point W position to the developing region X of first developing device 4, only the said first developing device 4 is successively operated.

After a time period $t_1$ from switching ON reed switch 159, when the boundary portion Z of the aforesaid electrostatic latent image reaches developing region X, the first developing motor 174 is switched OFF, while the first developing device solenoid 183 is switched ON. The first developing device 4 is thereby set in the state illustrated in FIGS. 9 and 10 with the rotation of developing sleeve 162, supply roller 164 and screw 165 being stopped so that the intermediate portion between magnetic poles N1 and S1 confronts photoreceptor drum 10, and the waste toner developing process is completed.

Then, after a time period $t_2$, i.e., after the time ($t_1+t_2$=0.42 s) required for the boundary portion Z of the electrostatic latent image to move from exposure point W to developing region X of the second developing device 5, the motor 174' of said second developing device 5 is switched ON, while the second developing device 5 solenoid 183' is switched OFF. By the aforesaid functions the second developing device 5 is set in the state illustrated in FIGS. 7 and 8 with developing sleeve 162', supply roller 164' and screw 165' being respectively rotated in the direction of arrows c, d and e, and a magnetic brush is formed on the surface of developing sleeve 162', thereby establishing a state wherein it is possible to develop the latent image formed on photoreceptor drum 10. Then, second developing device 5 starts supplying black toner to the electrostatic latent image corresponding to region B. Second developing device 5 operates until the scan is completed, at which point the document image developing process is completed. By the aforesaid functions during the time from the start of the scan until its completion, a changeover of the developing material is effected from waste toner to black toner, and a composite copy composed of a black binding band of waste toner as well as a black toner document is produced.

Figure 12A:
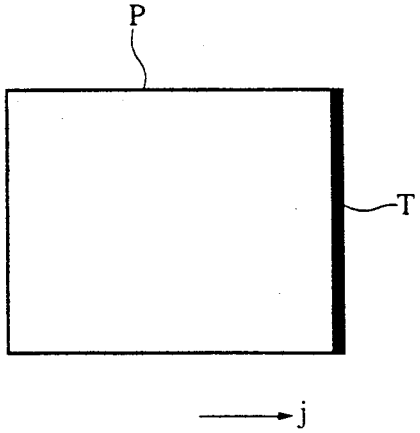
FIGS. 12*a* and 12*b* are top views of paper sheets showing the deposited binder toner.

FIG. 12*a* shows the state wherein binding (waste) toner T is deposited on the leading edge of sheet P in the transport direction by means of the previously described functions.

Sheet Binding Apparatus Construction and Operation

The sheet binding device 70 is described hereinafter with reference to FIG. 1.

Sheet binding device 70 is installed in copy machine 1 as an option, and comprises, in brief, tray 71, roller set 80 for delivering sheets discharged from copy machine 1 onto tray 71, heat rollers 78, bound sheets accommodating box 82, and guide 81 for guiding the bound sheets from tray 71 to accommodating box 82.

Tray 71 is disposed so as to be inclined at the top, and provided an aligning plate 72 which aligns the sheets in the width direction, aligning plate 73 which aligns the trailing edge of the sheets, and a paddle 75 which is rotatable in the direction indicated by arrow k. Regulating plate 73 is movable from the top of tray 71 by solenoid 74. Paddle 75 is provided a plurality of soft blades disposed radially, and is rotatably driven in the direction of arrow k, such that based on said rotation, sheets transported from roller set 80 are guided onto tray 71, while the trailing edge of the sheets accommodated in tray 71 are in contact with aligning plate 73 with said paddle in the rotating state, so as to assure proper alignment of said sheets.

Heat rollers 78 are normally located at the solid lines, and during the sheet binding operation are moved to the location indicated by the dotted lines to exert pressure on and heat the leading edge of the sheets accommodated in tray 71.

In the sheet binding device 70 of the aforesaid construction, paper sheets transported from roller set 80 are accommodated on tray 71, and heat rollers 78 apply pressure to the edge of the sheets and fuse the binding (waste) toner based on a binding signal. After fusion of the toner, the pressure applied by heat rollers 78 is released, while aligning plate 73 is retreated downwardly beneath tray 71 and the paddle 75 is rotatably driven, whereby the bound sheets are discharged from tray 71 by dead weight and the force applied by said paddle 75, and are successively guided by guide plate 81 to be accommodated in accommodating box 82.

Figure 13:
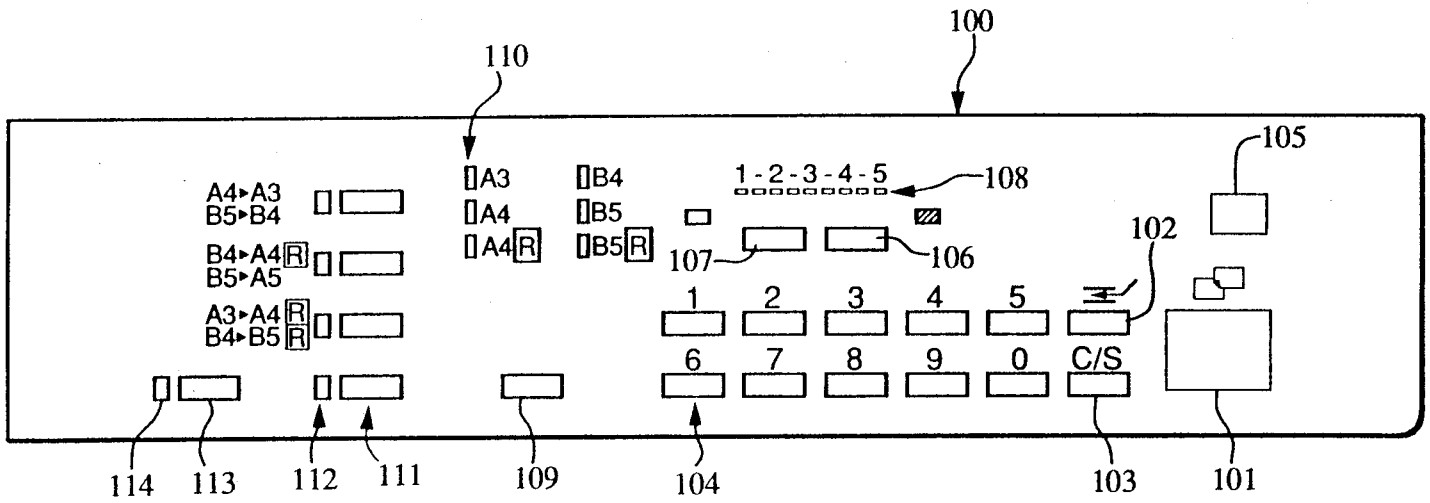

Control Panel (Refer FIG. 13)

A control panel 100 is provided on the top front surface of copy machine 1, and arranged thereon are a PRINT key 101 to start the copy function, INTERRUPT key 102 to temporarily interrupt the multicopy function, CLEAR/STOP key 103 to stop the copy function and cancel the register, ten-key pad 104 to set multicopy number (register), display portion 105 to display the copy number and copier status, UP and DOWN keys 106 and 107 for setting copy density and the related display LED group 108, paper selection key 109 to select paper size and the related paper size display LED group 110 to display the selected paper size magnification selection key 111 to select copy magnification and the related magnification display LED group 112 to display the selected magnification, bind mode selection key 113 to specify execution of the bind mode and the related bind mode selection display LED 114. Paper sized A4 and B5 is set beforehand in the vertical as well as horizontal directions R.

Figure 14:
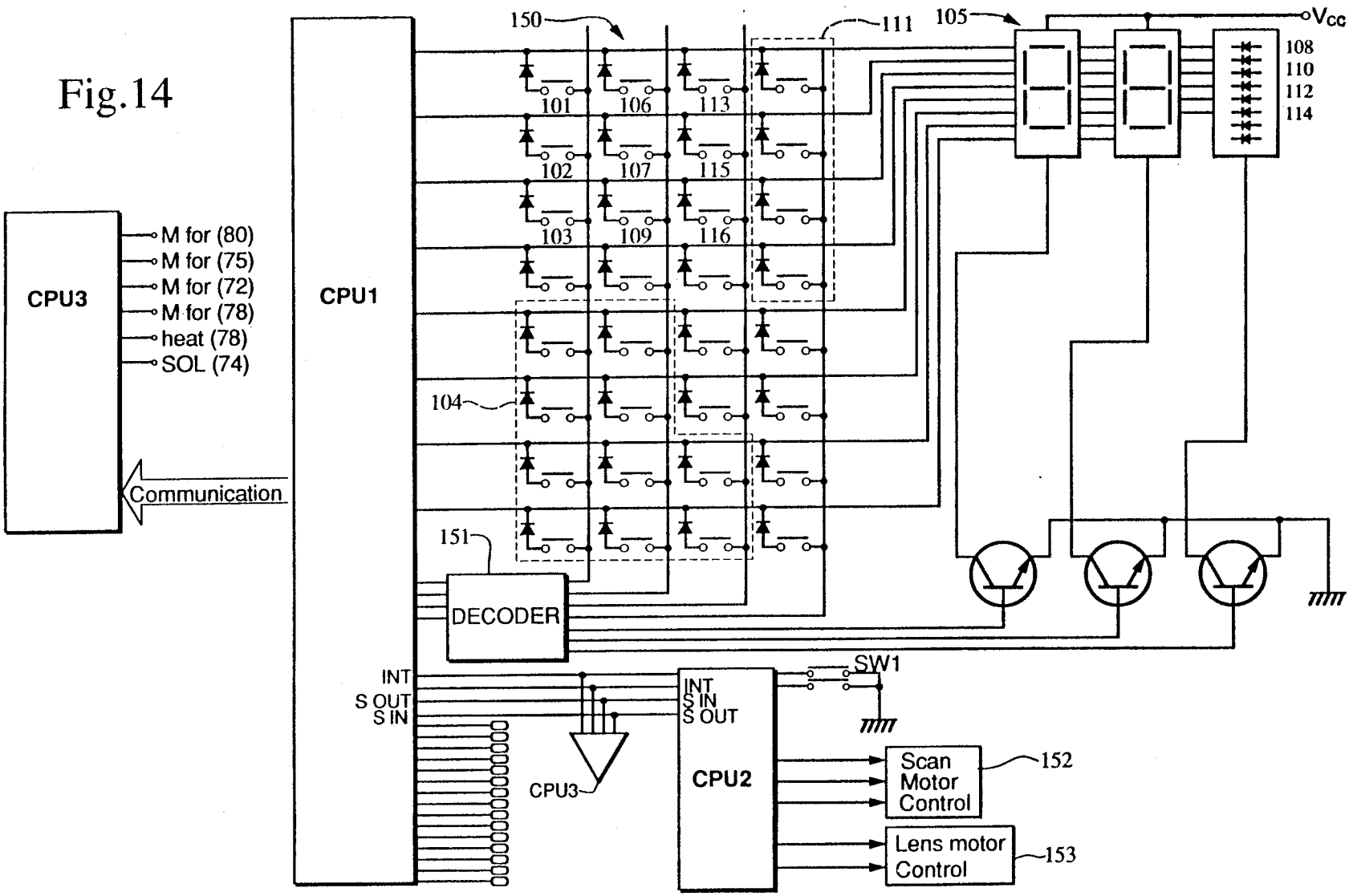

Control Circuit (Refer FIG. 14)

FIG. 14 shows the copier control circuit, wherein a central processing unit CPU1 is a first microcomputer for controlling the functions of copy machine 1, second CPU2 is a second microcomputer for controlling optical system 30, and third CPU3 is a third microcomputer for controlling the sheet binding device 70. In the diagram, item 150 is a switch matrix for display 105, item 151 is a decoder, item 152 is a scan motor drive actuating circuit for optical system 30, item 153 is a stepping motor actuating circuit for moving lens 35 to change the copy magnification. Meanwhile, the CPU1 output pin is connected to the transistors (not shown in the drawing) of each actuating switch for the copy machine 1 main motor, developing motor, timing roller clutch, first paper feed clutch, second paper feed clutch, charger, transfer charger.

On the other hand, CPU3 has a solenoid 74 connected thereto to actuate the heating means of heat rollers 78, aligning plate 73, and the motor for driving transport roller set 80, paddle 75 and aligning plate 72.

Figure 15:
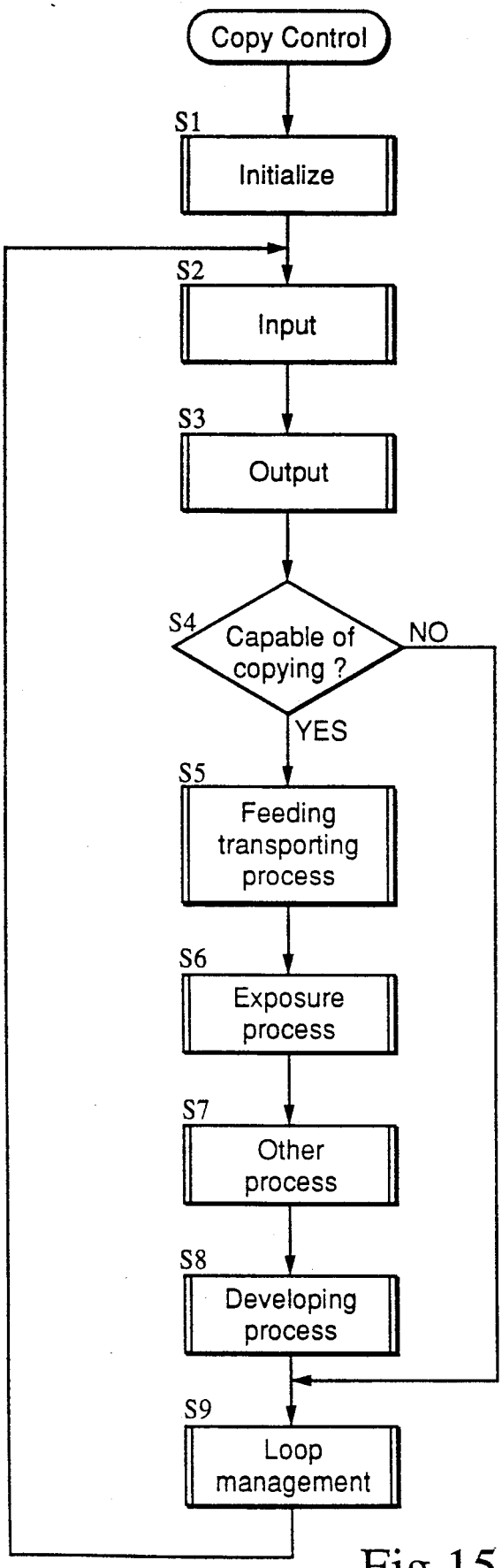
Figure 16A:
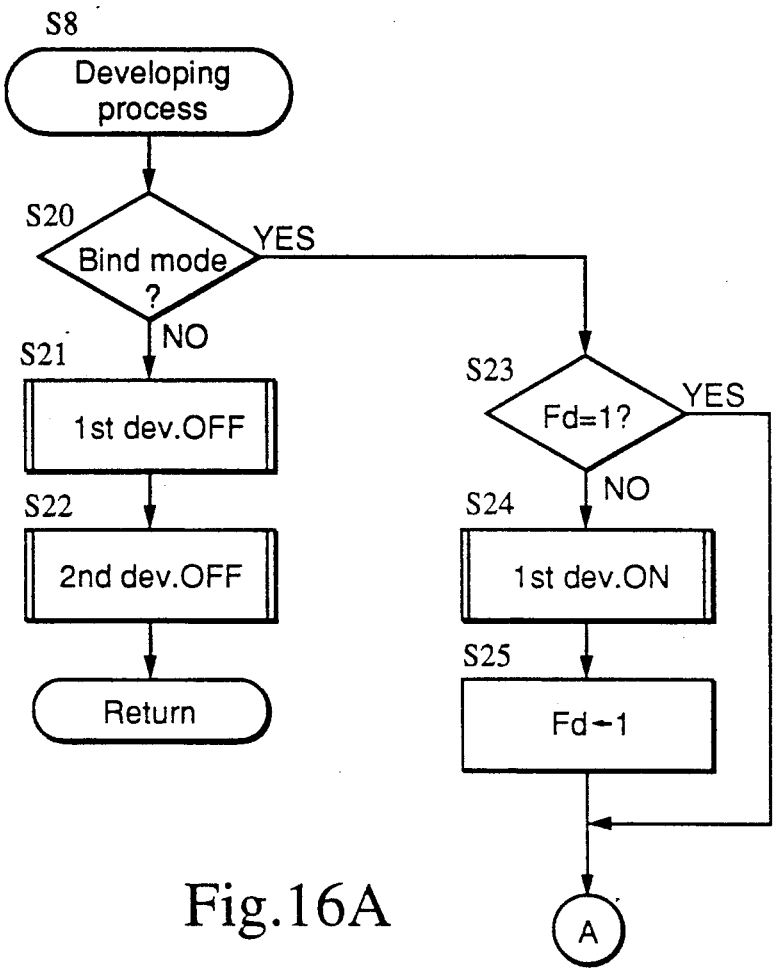
Figure 16B:
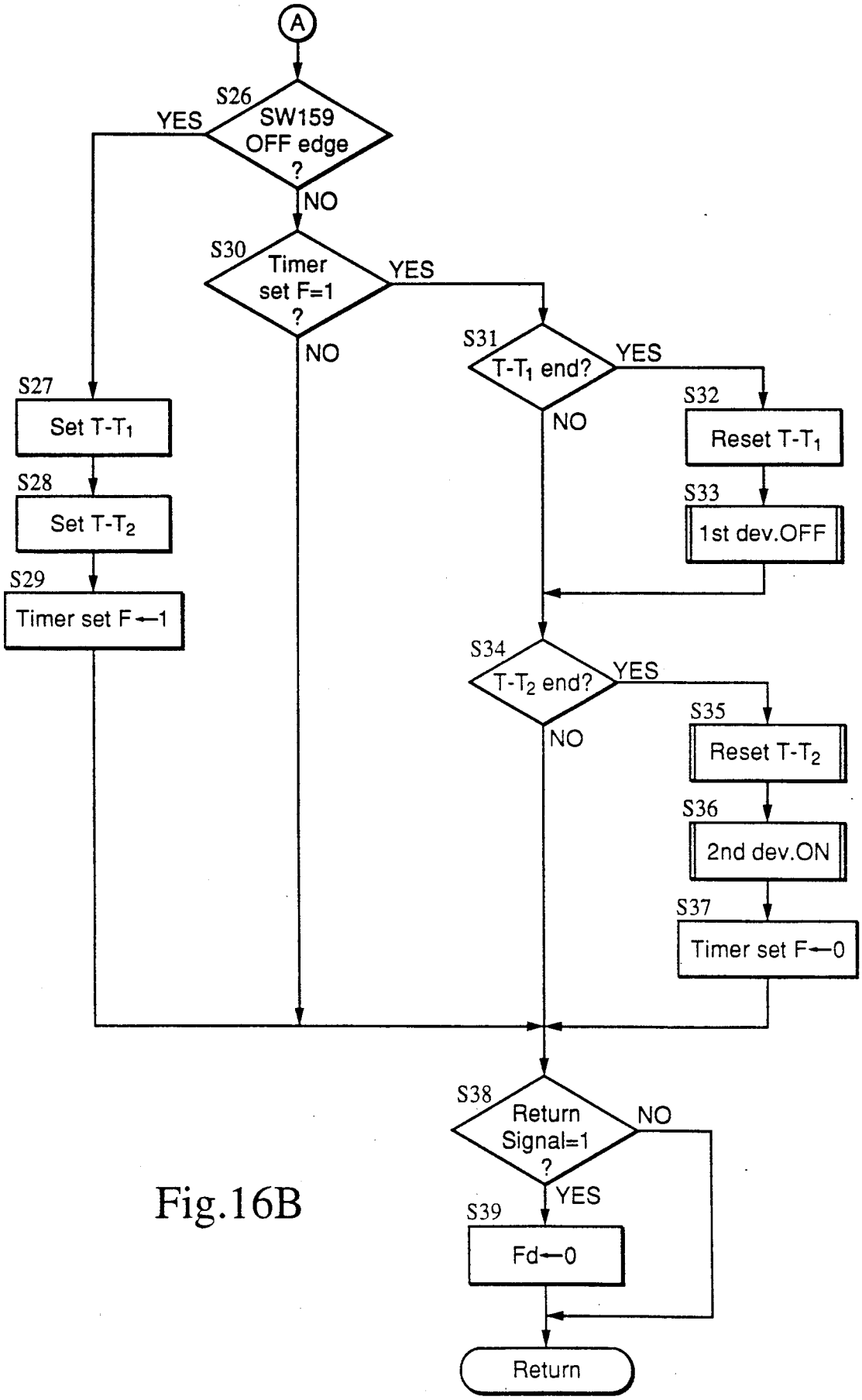

Control Sequence (Refer FIGS. 15, 16*a*, 16*b*)

The control sequence is hereinafter described with reference to the aforesaid control circuit and copy machine of the previously described construction.

FIG. 15 shows the copy control main routine executed by the first microcomputer CPU1.

When CPU1 is reset and the program starts, initialization is executed in step S1 to clear the random access memory (RAM), initialize each register and set the initialization mode for each device. Then, in step S2 data input from the control panel 100 is processed, while the output based on said input is processed in step S3. In step S4, a determination is made as to whether or not the copy machine is in the state capable of copying. If the machine is in the state capable of copying, the sheet feeding and transporting process is executed in step S5. In step S6, the exposure process by optical system 30 is executed, in step S7 the sheet jam detecting process and other processes are executed, and in step S8 the developing device process is executed. Subroutines in step S8 for ON/OFF switching of the first developing device 4 and second developing device 5 are executed as described below. Finally, in step S9, the loop management process is executed by an internal timer to regulate the time required to run one routine of the main routine, and to run each timer counter used in the subroutines.

FIGS. 16*a* and 16*b* illustrate the developing device process subroutines executed in step S8.

First, in step S20, a determination is made as to whether or not the bind mode has been selected. If the bind mode has not been selected, the first developing device 4 is placed in the non-operating state in step S21, and the second developing device 5 is placed in the operating state so that normal copy operations are performed using only the second developing device 5.

If the bind mode has been selected, a determination is made in step S23 as to whether or not the first developing device set flag Fd registers "1." When the first developing device set flag Fd is set at "1," the operational status of the first developing device 4 is displayed. Accordingly, if the aforesaid flag is set at "1," the routine then progresses to step S26, and if said flag is not reset to "0," then the first developing device 4 is placed in the operating state in step S24, the first developing device set flag Fd is set to "1" in step S25, and the routine continues to step S26.

Subsequently, in step S26, a determination is made as to whether or not the reed switch 159 is off edge (refer to FIG. 11), that is, the scan by optical unit 30 is started, reed switch 159 passes magnet 22, and when boundary Z between regions A and B shown in FIG. 2 reaches exposure point W, timer T-T1 is set in step S27, timer T-T2 is set in step S28, and the timer set flag is set to "1" in step S29. Timer T-T1 is set for a time period t1 during which the electrostatic latent image to which the binding (waste) toner is to be applied passes from the exposure point W to the developing region X of the first developing device 4, i.e., said timer is set for a time period during which photoreceptor drum 10 rotates through an angle $\alpha$ only. Timer T-T2 is set for a time period ($t1+t2$) during which the leading edge of the original document latent image passes from exposure point W to the developing region X' of the second developing device 5, i.e., said timer is set for a time period during which photoreceptor drum 10 rotates through an angle ($\alpha+\beta$) only.

If the reed switch 159 is not off edge, confirmation is made in step S30 that the timer set flag registers "1," and a determination is made in step S31 as to whether or not timer T-T1 has completed its cycle. If timer T-T1 has completed its cycle, said timer is reset in step S32, and the first developing device 4 enters the non-operating state in step S33. Then, in step S34, a determination is made as to whether or not timer T-T2 has completed its cycle. If timer T-T2 has completed its set time cycle, said timer is reset in step S35, and the second developing device 5 enters the operating state in step S36. The timer set flag is simultaneously reset to "0" in step S37.

Meanwhile, when the return signal set to "1" is verified, in step S38, the first scan is completed, and in step S39 the first developing device set flag Fd is reset to "0" and the subroutine is completed.

If waste toner supplied from the cleaning unit is used in the present embodiment, the cost of operating the copy machine as well as the labor of disposing of the waste toner are both reduced.

It is to be noted that the image forming device of the present invention is not limited to the embodiment described above, and that various changes and modifications are possible insofar as said changes and modifications do not depart from the scope of the present invention.

More specifically, a variety of special toners may be used as the binding toner in place of the aforesaid waste toner. For example, if a white toner is used as the binding toner, the sheet binding portion is less conspicuous and has a cleaner appearance. If a color toner is used as the binding toner, the sheet binding portion can be given a more colorful finish, and the bound sheets can be classified by the color of the bindings. In addition, if a highly self-adhesive toner is used, assurance of reliable sheet binding is enhanced. Typical toners may comprise carbon black or like dyes, binder resin and electric charge regulating resin. Increasing the self-adhesion of the main constituent resin will enhance the self-adhesion of the toner. For example, when low molecular weight resins such as styrene-acrylic resins are used, consideration should be given to increasing the percentage of acrylic and use of an epoxy resin which is highly self-adhesive compared with styrene-acrylic or polyester resins.

When the aforesaid special toner is used, the special toner is accommodated in the first developing device 4, and deposited as a binding toner to a band-like zone on the front edge of the sheet and is controlled in an identical manner to that described in FIGS. 11, 15, 16*a* and 16*b*.

Figure 12B:
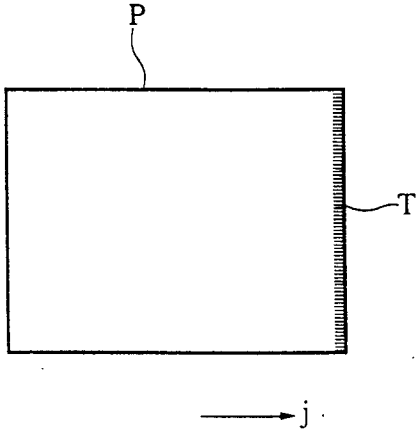

The special toner may also be deposited in a striped pattern lengthwise along the front edge of sheets P, as shown in FIG. 12*b*. More specifically, the non-reflective nonspecular process portion 21*a* of document scale 21 may be formed by applying a striped patterned application of a black coating thereon, thereby increasing the strength of the bound sheets with respect to bending in the direction of toner deposition.

Second Embodiment

The construction of the copy machine using the second embodiment of the present invention is substantially the same as that shown in FIG. 1, with the exception of the construction of the document glass platen and that the second embodiment is provided only a single developing device.

Figure 17:
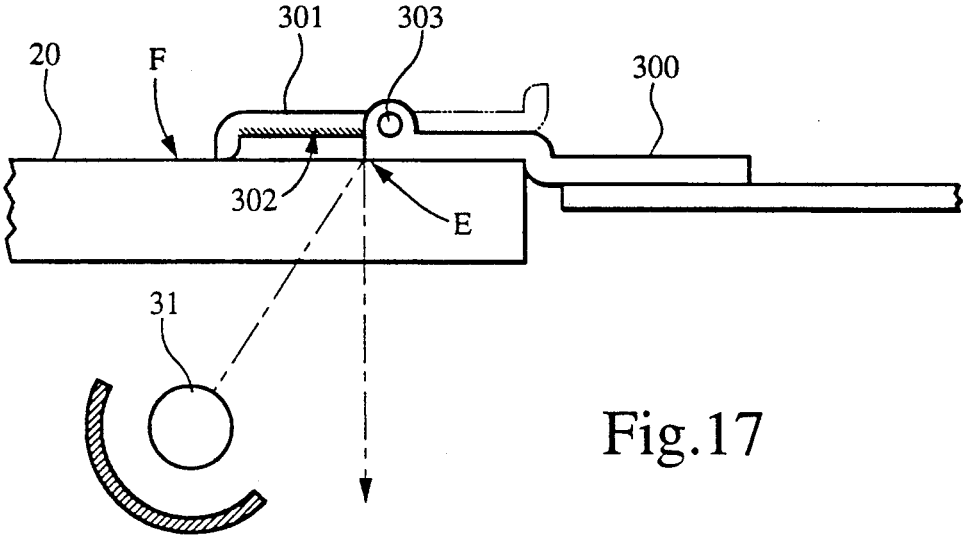
FIGS. 17, 18 and 19 show the second embodiment of the image forming apparatus of the present invention.

Details of the second embodiment are described below and pertain to a copy machine, shown in FIG. 17, provided a document scale 300 at the image exposure start position on the document glass platen 20, and an auxiliary document scale 301 rotatably disposed with pin 303 of document scale 300 as the support point. Auxiliary scale 301 is provided a nonreflective process (for example, a black coating) along the entire length of portion 302 designated by the oblique lines in FIG. 17, said scale 301 normally being disposed upon scale 300, as indicated by the dotted line in the drawing. An original document (not shown in the drawing) is placed on glass platen 20 and positioned at edge E of document scale 300 because image exposure begins from said portion E.

On the other hand, during a sheet binding process, auxiliary document scale 301 is set upon glass platen 20, as indicated by the solid line in the drawing. At this time, the original document is placed on glass platen 20 so as to cover auxiliary document scale 301 or positioned at edge F of said scale 301. Image exposure starts from portion E just as in a normal copy function, and timing roller set 45 is switched ON with the same timing as for transporting a sheet to the transfer section. Accordingly, while exposure light is projected from the exposure lamp 31 to nonreflective process portion 302, said light does not reach the surface of photoreceptor drum 10, and the surface potential of said photoreceptor drum 10 remains as a region of high electric potential while being charged by charger 11.

Figure 18:
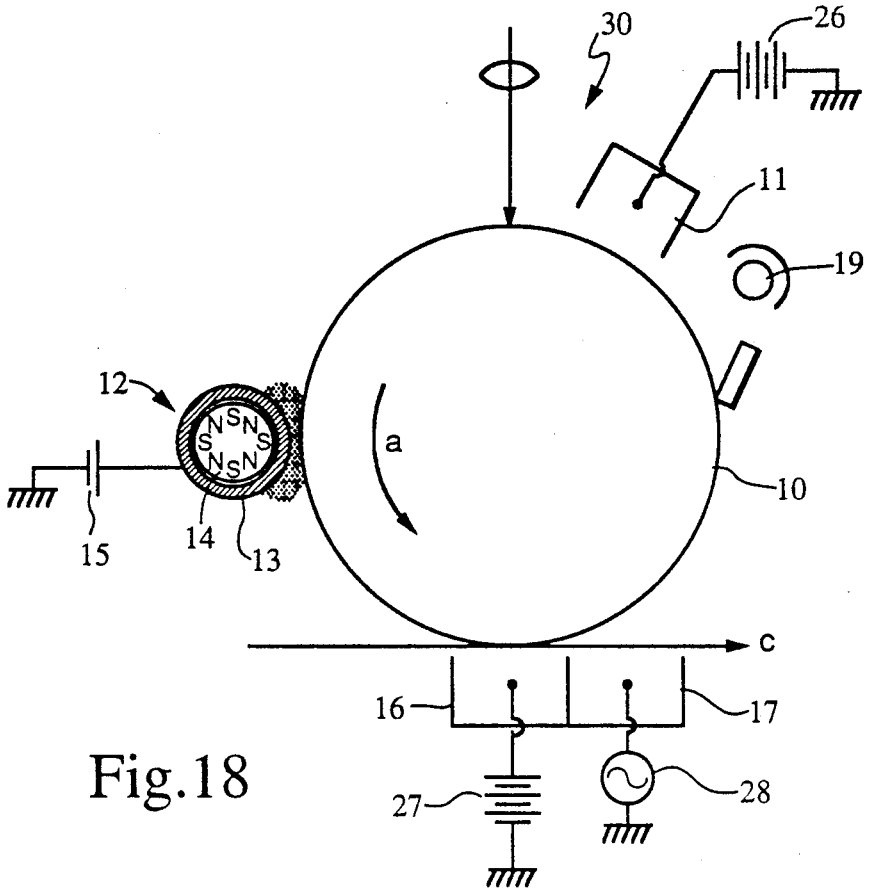

Next, the power sources for the various chargers are described with reference to FIG. 18.

First, a power source 26 which supplies a positive polarity voltage is connected to the charge wire of charger 11.

A power source 27 which supplies a positive polarity voltage is connected to the charge wire of transfer charger 16, and a power source 28 which supplies an AC voltage is connected to the charge wire of separation charger 17.

Image Forming Process

First, the surface of photoreceptor drum 10 is charged to produce a uniform electric potential thereon, the original document image is exposed based on the scan by optical unit 30 in the direction indicated by arrow b, and an electrostatic latent image is formed on said photoreceptor drum 10. The latent image is produced so that an image portion remains as a high electric potential portion of positive polarity, and a non-image portion formed as a positive image discharged to about +100 V.

When the aforesaid auxiliary document scale 301 is placed on document glass platen 20 for binding the sheets, the exposure light does not reach that portion on the surface of photoreceptor drum 10 corresponding to the leading edge of said sheet in the sheet transport direction j due to the interposition of the previously described nonreflective portion 302, such that the surface potential of photoreceptor drum 10 remains as an image portion and a band having the same electric potential.

Subsequently, the regular latent image portion and the band-like high electric potential portion are both developed by developing device 12. A toner charged with a negative polarity is adhered to the high electric potential portion on the surface of the photoreceptor drum, i.e., to the regular latent image portion and the band-like leading edge high potential portion. Thus, the adhered toner is transferred to the copy sheet by a negative polarity discharge from transfer charger 16, said toner then being fixed thereon by a fixing device 47, and discharged by discharge roller set 48.

By the aforesaid process binding toner T is adhered deposited on the leading edge of the sheet in the sheet P transport direction g.

In addition, auxiliary document scale 301 need not be rotatable type, but may be a sliding type that slides from the prepositioned document scale 300.

Furthermore, the binding toner fusing means may be heating plate capable of applying pressure to the leading edge portion of the sheet stack, as described hereinafter, used in place of the aforesaid heat rollers 78.

Figure 19:
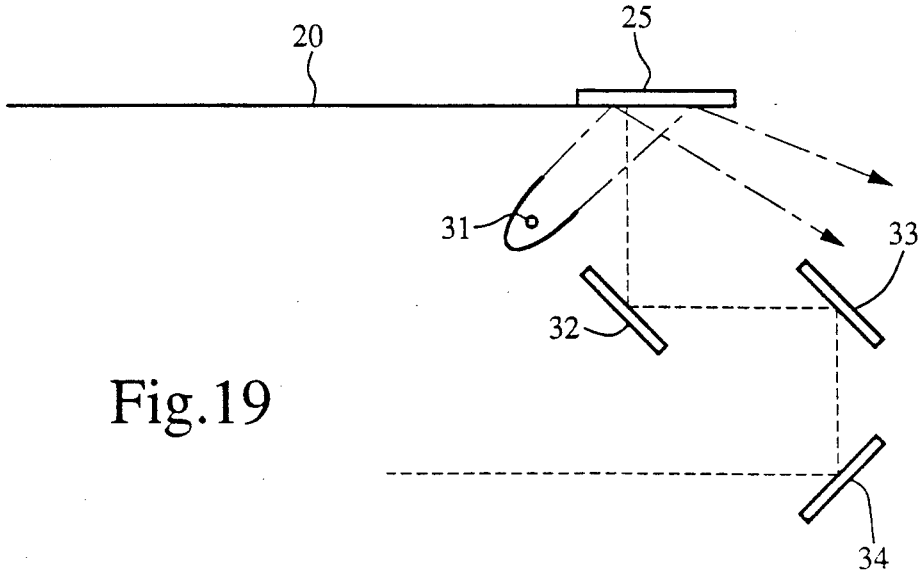

An embodiment is shown in FIG. 19, wherein an auxiliary mirror 25 is retractably disposed at the image exposure starting position on glass platen 20 in place of the aforesaid auxiliary document scale 301. In this embodiment, the light projected from exposure lamp 31 and reflected by the auxiliary mirror 25 is not projected to first mirror 32, such that the same effect is obtained as by using the aforesaid auxiliary document scale 301.

Various types of components other than a mirror may be used if said components can diffuse the non-specular reflection light to a portion other than first mirror 32.

In addition, if the nonreflective process portion 302 of auxiliary document scale 301 is coated with a striped pattern of black and white coating materials, toner can be deposited in a striped pattern, as shown in FIG. 12*b*.

Further, if the portion near the exposure starting position E on the aforesaid nonreflective process portion 302 is allowed to retain a white margin, a small margin will remain on the leading edge of the sheet.

Third Embodiment

The construction of a copy machine provided a third embodiment of the present invention is substantially the same as that shown in FIG. 1, except that the copy machine of the present embodiment is provided a single developing device, a sub-charging scorotron charger 400 for forming the binder toner between the charger 11 and developing device 12, an automatic document feeder (hereinafter referred to as ADF) 400 described below, and uses a heating plate in the sheet binding device.

ADF 200 is disposed on top of copy machine housing 1, and is linked to said copy machine so as to operate the copy function.

ADF 200 broadly comprises a document feed portion 201 which accommodates the original documents and feeds said documents one sheet at a time, and a document transport portion 204 which transports the fed document sheet onto the glass platen 20 by means of a transport belt 206, stops said sheet on glass platen 20 at a specific location, and delivers the sheet to a discharge tray 208 after the image exposure is completed. In the state wherein document transport portion 204 is installed on top of copy machine housing 1, said portion 204 can be opened relative to the copy machine housing 1 so as to expose glass platen 20, and can be used in the same manner as a normal document cover.

Copy machine 1 is provided a magnet (not shown in the drawing) so that, when the document transport portion 204 is closed, a reed switch OSW is switched ON when said magnet is detected, and switched OFF when said magnet is released. When switch OSW is switched ON, control of the ADF 200 and copy machine 1 are mutually linked and the operating mode of the copy machine 1 can be switched to ADF mode. The ADF mode is initiated when the print key 101 on copy machine 1 is actuated, and the ADF starts operation while the copy machine 1 is maintained in the ready state, so that when an original document placed on document tray 203 is transported across the top of glass platen 20, said sheet stops a specific position, a start signal is output from the ADF 200 to copy machine 1, and the copy machine operation starts. When the final image exposure of the document is completed, an operation signal is transmitted from the copy machine 1 to the ADF 200, and the document is discharged onto discharge tray 208. At this time, a subsequent document is transported to the specified position. Documents in document tray 203 are detected by an empty sensor ES. The ADF mode can be run continuously on copy machine 1 as long as a document is detected by empty sensor ES.

In addition, ADF 200 is provided a means to automatically detect document size. That is, the width of a document fed from document feed portion 201 is detected by a plurality of individual document size sensors SSE arranged in the document receiving portion of transport portion 204, and the length of the document is detected by monitoring the time required for said document to pass the sensor SSE detecting point.

Binding Toner Forming Means

Figure 21:
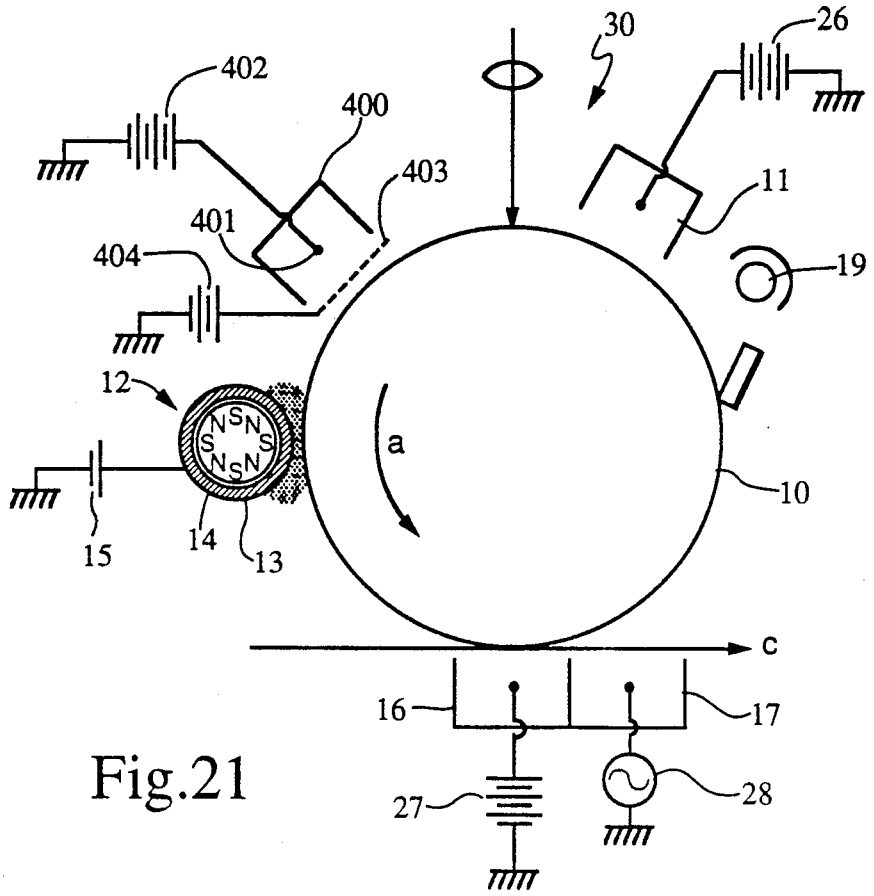
Figure 22:
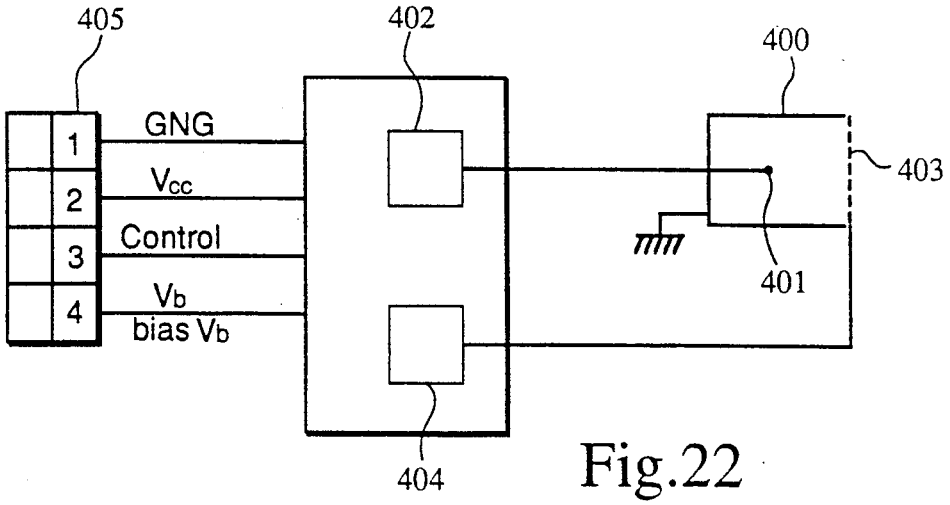
Figure 23:
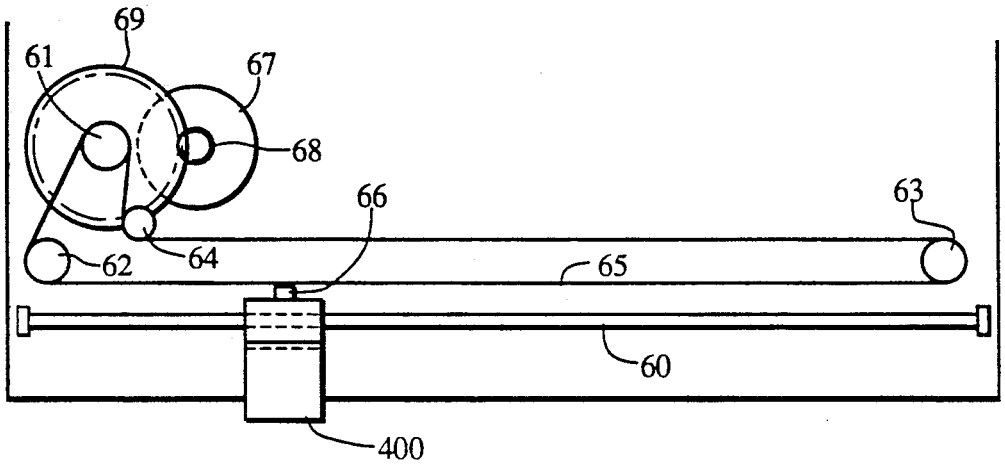

A description of the scorotron charger 400 follows hereinafter with reference to FIGS. 21, 22 and 23.

The power source portion of other type chargers are the same as described in the second embodiment.

The charge wire 401 of scorotron charger 400 has connected thereto a power source 402 which supplies a positive polarity voltage. Grid 403 is connected to a power source 404 which supplies a positive polarity voltage and, said grid regulates the charge amounts applied to photoreceptor drum 10 from charge wire 401. Power sources 402 and 404 are controlled by the aforesaid microcomputer CPU1 via a pin block 405.

Figure 24:
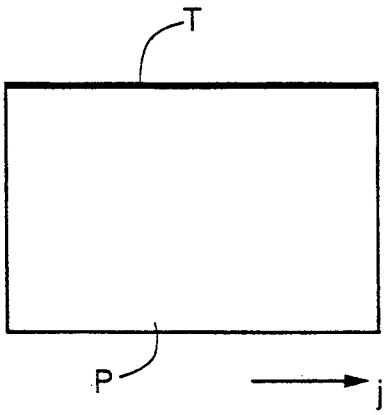

Scorotron charger 400 is provided as a recharging means to adhere the binding toner on the edge of the sheet, and in the present embodiment, deposits a band of toner T on one side parallel to the sheet P transport direction j, as shown in FIG. 24. Scorotron charger 400, therefore, has an emission portion which corresponds to the width of the band of binding toner T, and recharges a band on one edge of photoreceptor drum 10.

On the other hand, in the present embodiment, the sheet is transported based on its center portion in the transport path width direction. Accordingly, the location of the charge for depositing the band of binding toner T differs depending on the paper size. The scorotron charger 400 is movable along the width of photoreceptor drum 10 in accordance with the paper size. In concrete terms, the scorotron charger 400, which is slidably mounted on guide shaft 60 provided in the axial direction of photoreceptor drum 10, as shown in FIG. 23, is held by a wire 65 stretched around pulleys 61 through 64 via a metal fitting 66, and the output gear 68 of the stepping motor 67 engages a gear 69 fixedly mounted on the same shaft as pulley 61.

Accordingly, by driving the stepping motor 67 in accordance with the paper size, the scorotron charger 400 is moved toward the recharging position corresponding to the band-like toner deposit region on the paper sheet.

Image Forming Process

First, an electrostatic latent image is formed on the surface of photoreceptor drum 10 in the same manner as described in the second embodiment.

Then, the edge of the photoreceptor drum 10 which has the aforesaid latent image formed thereon has a positive polarity charge imparted thereto by the scorotron charger 400. At the same time, scorotron charger 400 is displaced by the stepping motor 67 to a position which corresponds with the paper size so as to recharge a band on the surface of the photoreceptor drum 10 with the same electric potential as the image portion.

Subsequently, the developing, transfer and fixing processes are accomplished in the same manner as described in the second embodiment.

Sheet Binding Apparatus Construction And Operation

The sheet binding apparatus used in the present embodiment has substantially the same construction as shown in FIG. 1. However, in the device of the present embodiment, a heating plat 76 is used in place of the heating rollers 78.

Heating plate 76 is provided on the side at which a band of the binding toner is deposited, as previously described, and is movable orthagonally relative to tray 71 by means of solenoids 77. The heating plate 76 is position-adjustable in the width direction by means of a drive mechanism (not shown in the drawing) and a width adjusting plate 72, in much the same way as the scorotron charger 400 is adjustable in relation to the paper size.

The binding operation performed by the sheet binding device 70 having the construction described above is identical to the device shown in FIG. 1.

In the present invention, when the sheet used as the cover sheet for the bound copies is fed to the transfer portion, the process can be controlled so that the binding toner is not deposited upon said sheet. The cover sheet can be bound to the second page sheet by means of the binding toner deposited upon said second page sheet.

Figure 20:
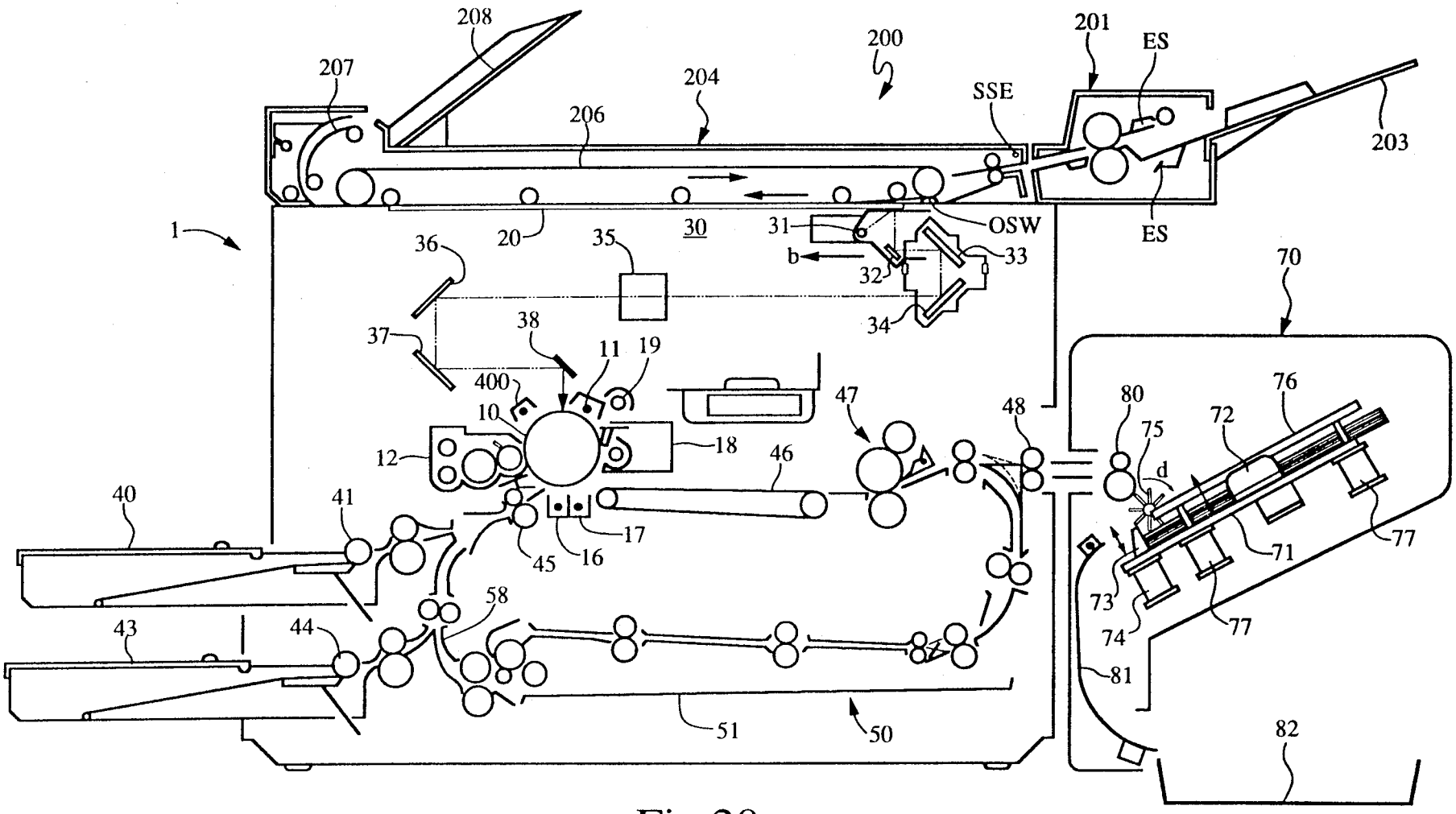

The modes of discharging the used copy paper include discharging the copy paper face up whereby the image bearing surface of the paper is facing upward, and face down whereby the image bearing surface of the paper is facing downward. The sheet binding device shown in FIG. 20 is used to discharge sheets face down. If the sheet re-feed unit 50 is used, however, sheets may be discharged face down.

Accordingly, when the copy machine 1 provided with an ADF 200 and the sheet binding device 70 are linked to make copies in the bind mode, there are two modes of operation to be considered. The first mode disposes a stack of original documents on document tray 203 with the image bearing surfaces facing down and arranged in order from the last page, so that when the final sheet (the first page) of the document is fed, the aforesaid scorotron charger 400 does not operate, and only the document image is transferred to the copy paper (cover sheet), said sheet is thereafter discharged to the sheet binding device 70 and subjected to the binding process. In the second mode, both the document image and binding toner are transferred from the final sheet (the first page) in a stack of original documents, and a separate cover sheet is then fed through the transfer portion without being subjected to the image forming process, discharged to sheet binding device 70 and undergoes the sheet binding process. In this case the paper used for the cover sheet is the same size as the paper used for document copies. Of course, the paper used for the cover sheet may be a sheet of the same size but a different color.

A detailed description of the control sequence for the aforesaid two operation modes follows hereinafter with reference to the flow charts.

Control Sequence (Refer FIGS. 25 to 36)

Control sequences are described in detail below based on a copy machine and control circuitry of previously described construction. In the following explanation, the term "on edge" is used to mean the change-over of switch sensors, signals and the like from the OFF state to the ON state, and the term "off edge" is used to mean change-over of said switch sensors, signals and the like from the ON state to the OFF state.

An explanation follows for the control of the first mode, i.e., the previously described first operation mode wherein the final sheet of the document stack (first page of the document) is copied without binding toner being deposited on the copy paper and said copy paper is used as the cover sheet.

Figure 25:
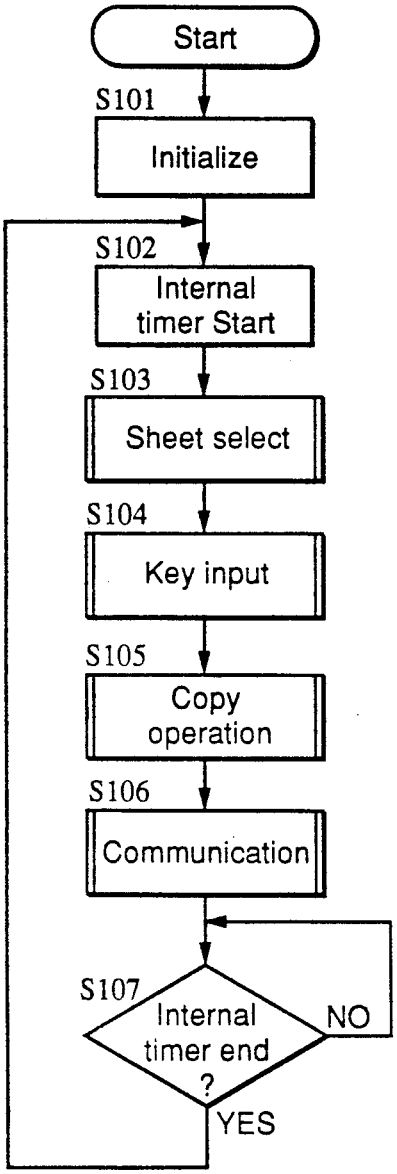

FIG. 25 shows the main routine of the previously mentioned first microcomputer CPU1.

When CPU1 is reset and the program starts, initialization is executed in step S101 to clear the random access memory (RAM), initialize each register and set the initialization mode for each device. Then, in step S102, the internal timer provided in CPU1 is started. This internal timer determines the specific timer period during which the main routine runs, and the value set in the timer is predetermined and set during initialization in step S101.

Next, in steps S103, S104 and S105, each subroutine is called in sequence, and when all subroutines have been processed, CPU1 communicates the data to CPU2, CPU3 and CPU4 in step S106. In step S107, the completion of the aforesaid internal timer is awaited and one routine ends. Various timers used in each of the subroutines counts using the length of time required to complete the aforesaid one routine. That is, all counters in each of the subroutines count by counting the number of times the one routine runs so as to determine when said timer cycle ends.

Figure 26:
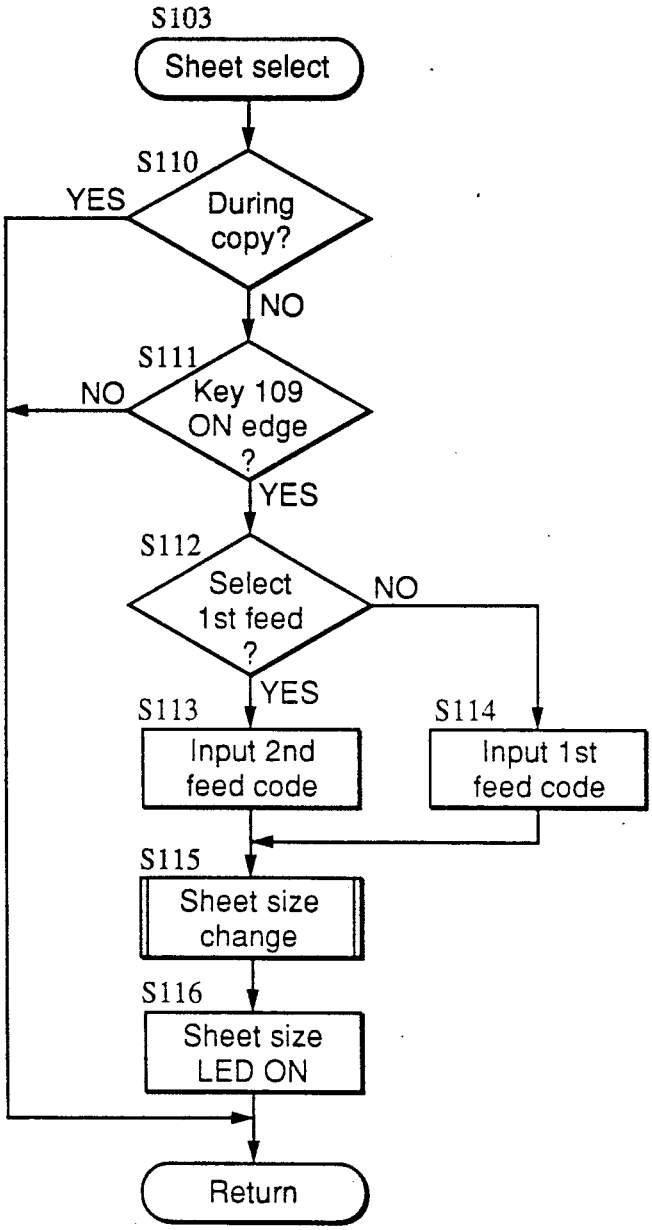

FIG. 26 shows the paper selection routine executed in step S103 of the main routine.

When it is determined in step S110 that the copy function is not in progress and determined in step S111 that the paper selection key 109 is on edge, a determination is then made in step S112 as to whether or not the first feed cassette 40 has been selected. If the result of inquiry is YES, the second feed cassette 43 is selected, and if NO, the first feed cassette 40 is selected. Then in steps S113 and S114, the respective paper size codes are input. In step S115, the paper size code change routine is executed, and in step S116 one of the set paper size LEDs is turned ON.

Figure 27A:
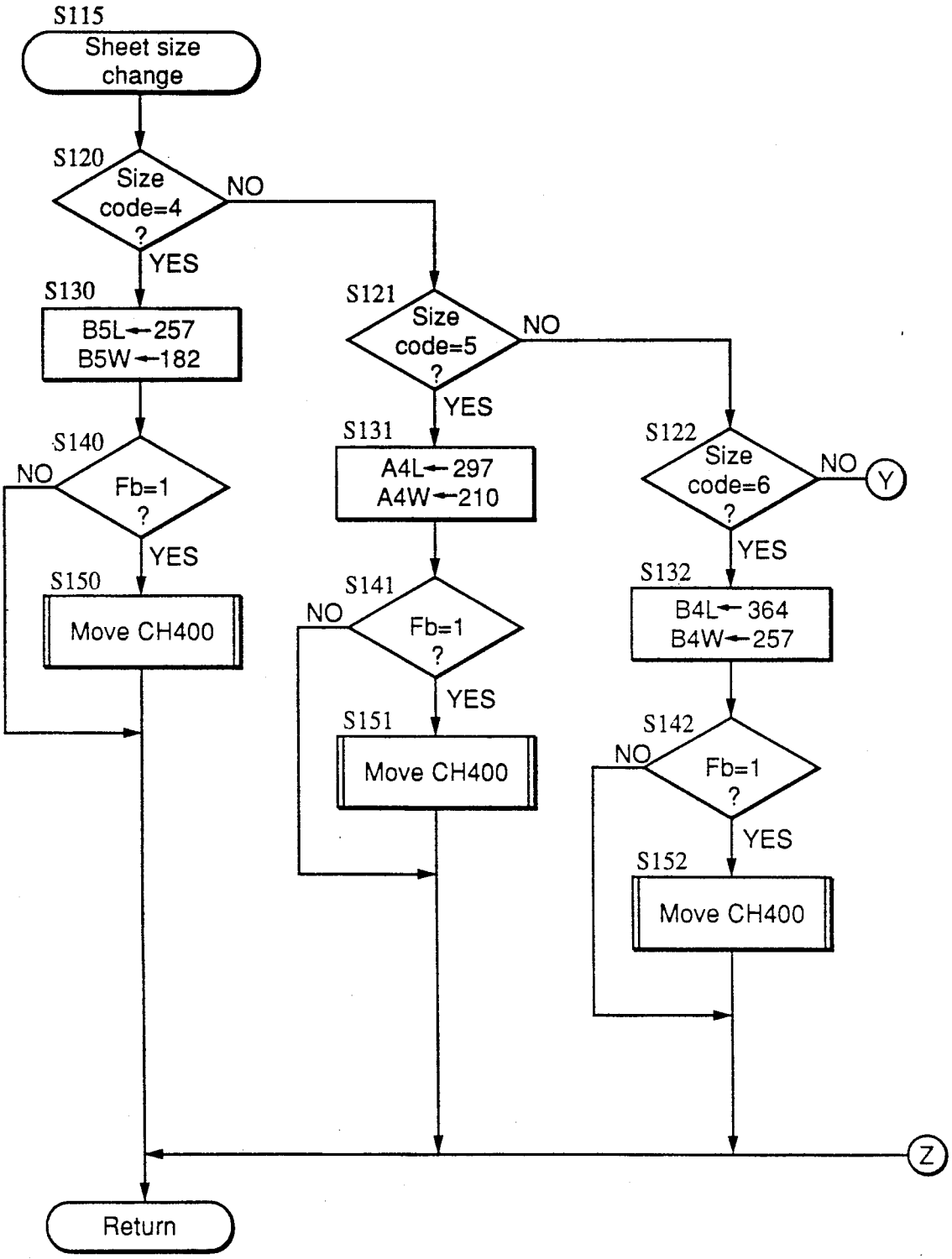
Figure 27B:
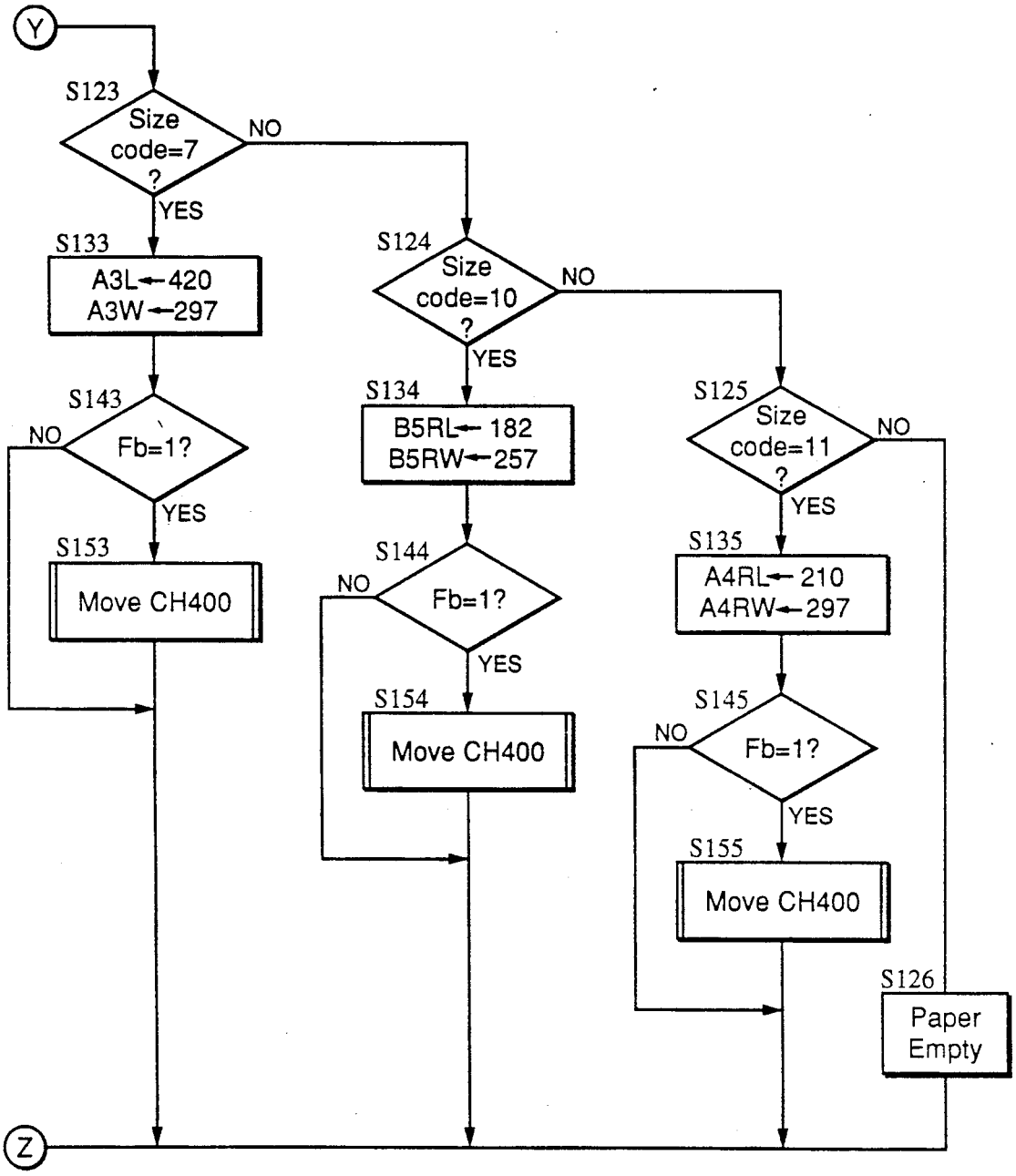

FIGS. 27*a* and 27*b* show the sheet size change routines executed in step S115.

First, in step S120, a determination is made as to whether or not the size code is "4." If size code input in the aforesaid steps S113 and S114 was "4," a sheet length L in the transport direction of 257 mm and sheet width W of 182 mm are stored in memory in step S130 because the code "4" is the B5 sheet size portrait (vertical) orientation (B5R) code.

When it is determined in steps S121, S122 and S123 that the sheet size codes "5," "6" and "7" respectively have been input, then the sheet length in the transport direction and width are stored in memory in step S131 (length 297 mm, width 210 mm), step S132 (length 364 mm, width 257 mm), step S133 (length 420 mm, Width 297 mm) respectively, because said codes "5," "6" and "7" are, respectively, the A4 portrait (A4R), B4 portrait (B4R) and A3 portrait (A3R) codes. Additionally, when it is determined in steps S124 and S125 that sheet size codes "10" and "11" have been input, the sheet length in the transport direction and width are stored in memory in step S134 (length 182 mm, width 257 mm) and step S135 (length 210 mm, width 297 mm) respectively, because said sheet size codes "10" and "11" are the B5 landscape (horizontal) orientation (B5Y) and A4 landscape (A5Y) codes respectively. After storing the sheet size code in memory as described above, a determination is made in each of the steps S140 to S145 as to whether or not the band forming flag Fb is set at "1." When the band forming flag Fb is set to "1" it assigns the bind mode in the key input routine, as shown below, which allows the bind mode to be implemented. If the band forming flag Fb is set to "1," the scorotron charger 400 is displaced to the position for depositing the binding toner in accordance with the dimensions of the paper selected in steps S150 to S155. This displacement of the scorotron charger is accomplished by actuating the aforesaid stepping motor 67 as previously described, so details are omitted here.

A NO reply to the inquiries in steps S120 to S125 mean there is no paper in the cassettes 40 and 43 so paper empty signals are output in step S126.

Figure 28:
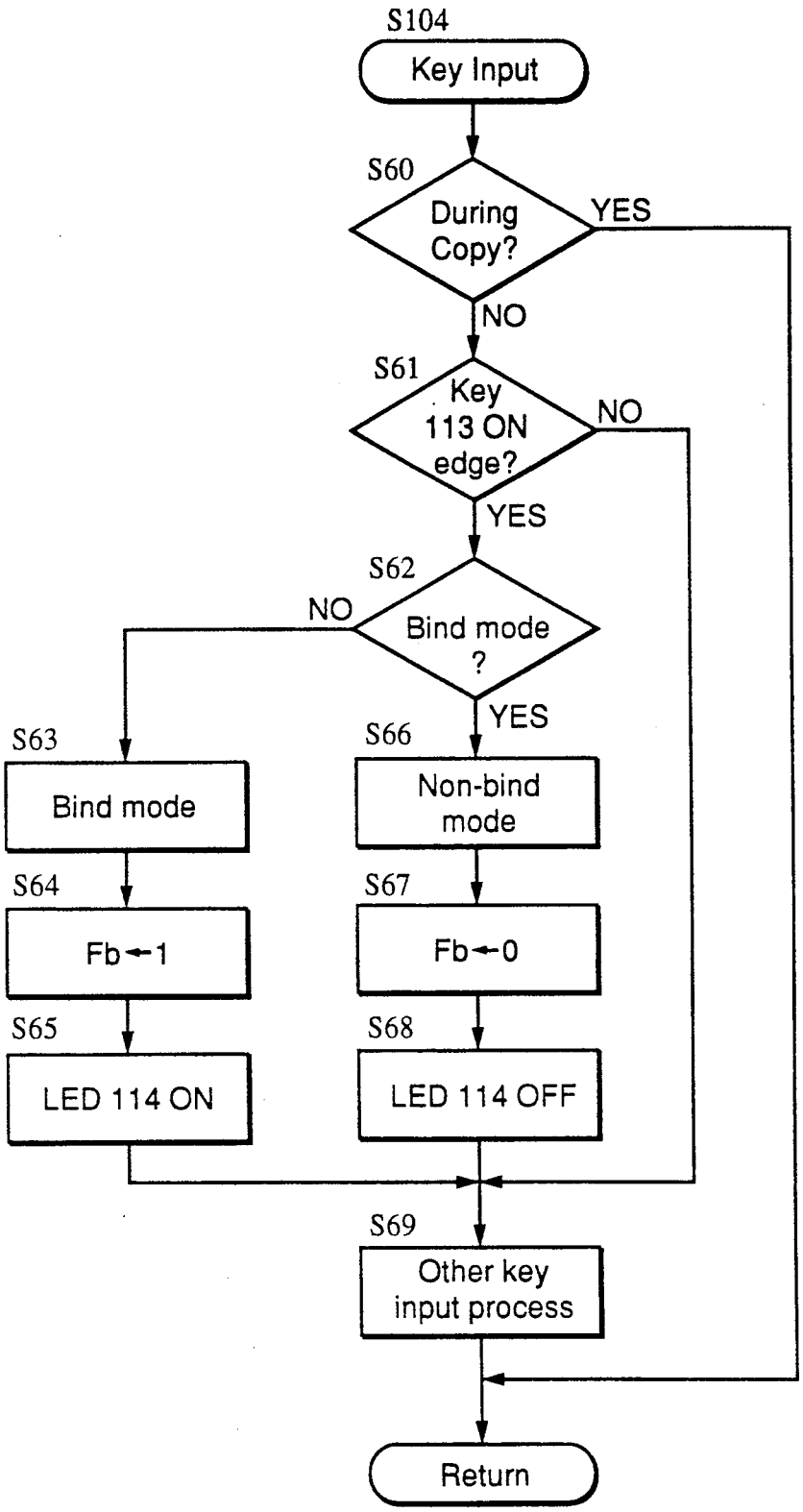

FIG. 28 shows the key input routine executed in step S104 of the main routine.

First, when a determination is made in step S60 that the copy function is not in progress, and the bind mode selection key 113 is found to be on edge in step S61, a determination is made in step S62 as to whether or not the bind mode is currently selected. If the bind mode is not currently selected, the bind mode is set in step S63, the band forming flag Fb is set to "1" in step S64, and the display LED 114 is turned ON in step S65. However, if the bind mode is found to be currently selected in step S62, i.e., if the key 113 is turned ON a second time, the bind mode is cancelled in step S66, the band forming flag Fb is reset to "0" in step S67, and the display LED 114 is turned OFF in step S68.

When the above process is completed, other key inputs are processed in step S69, and those subroutines are completed.

Figure 29A:
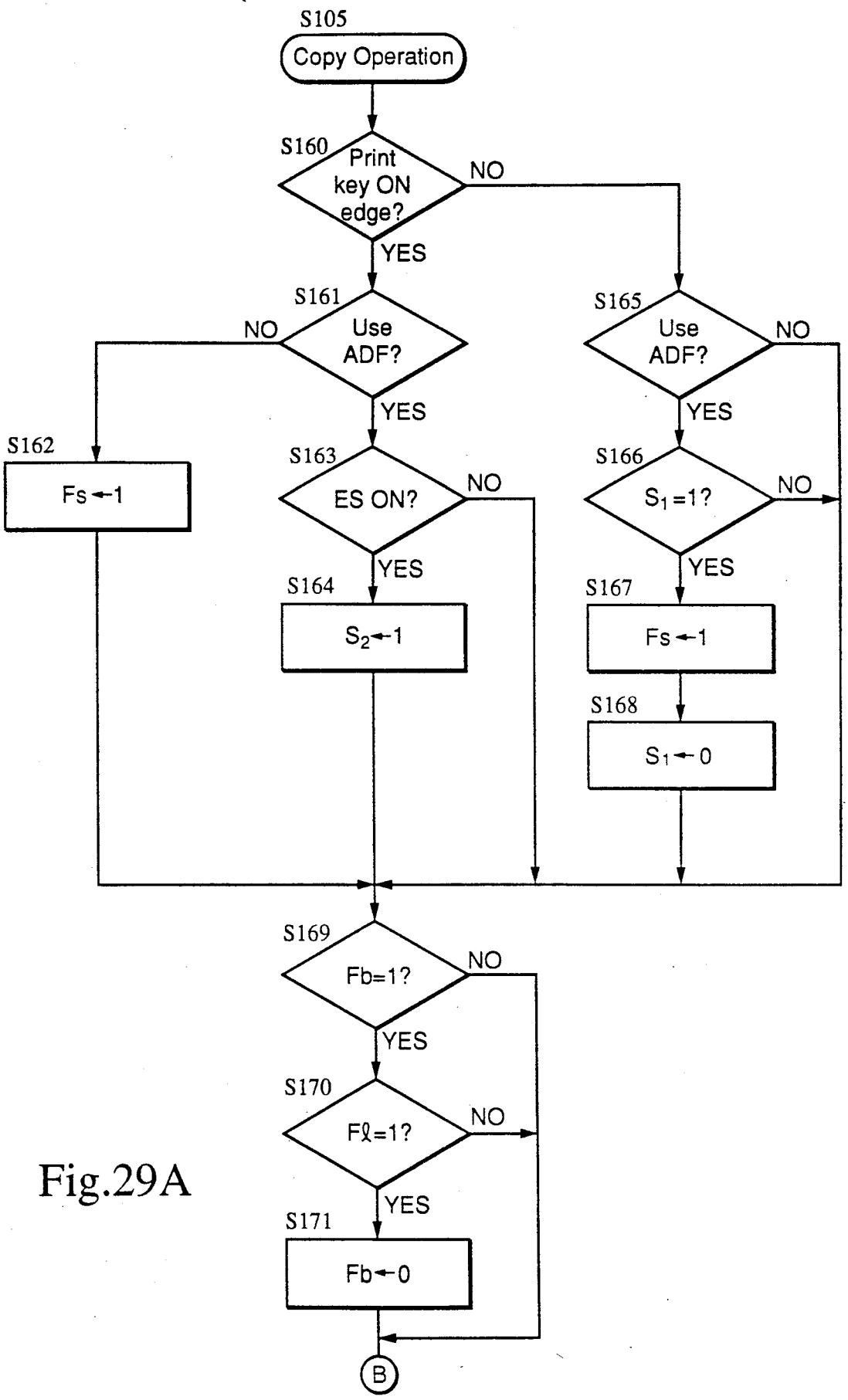
Figure 29B:
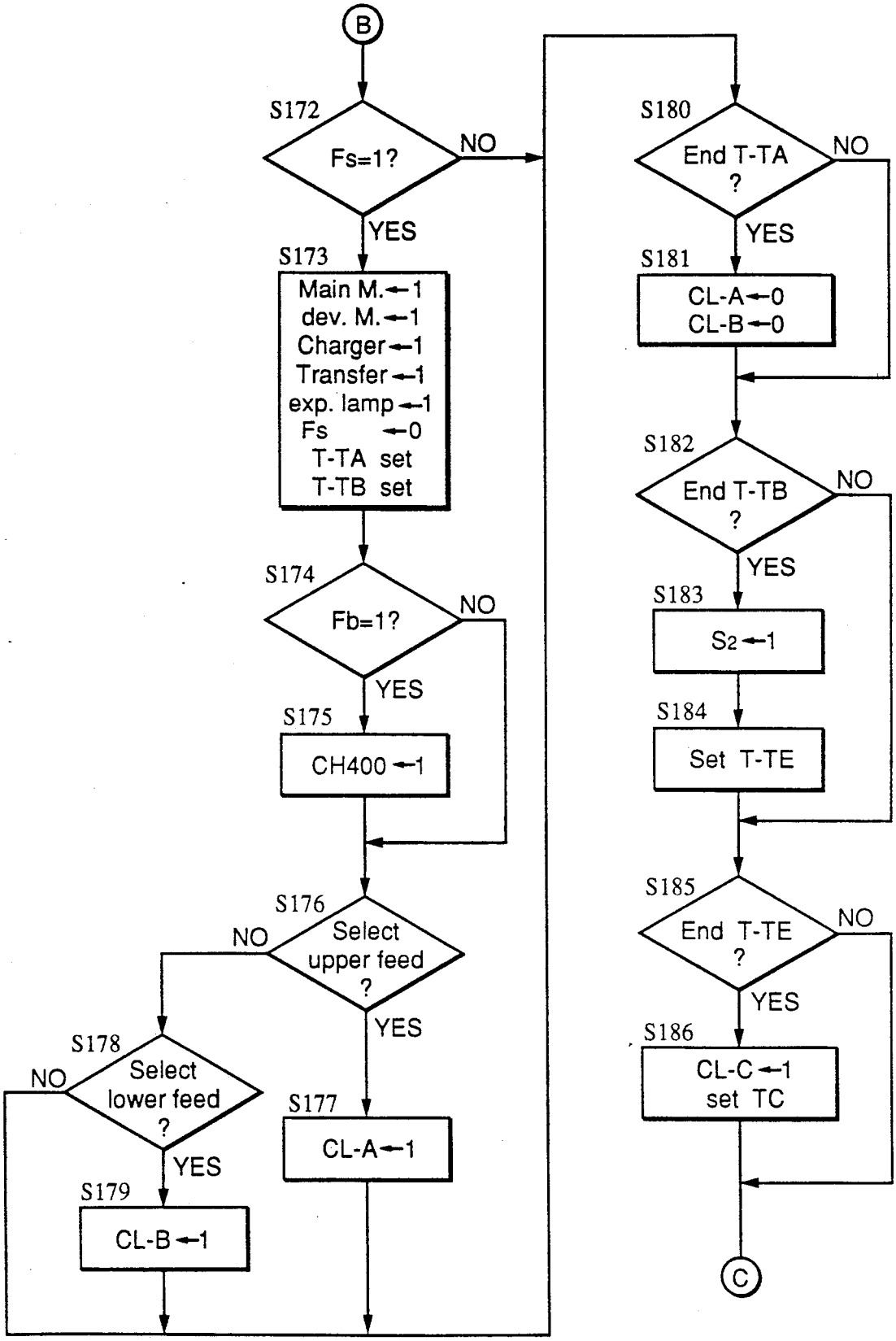
Figure 29C:
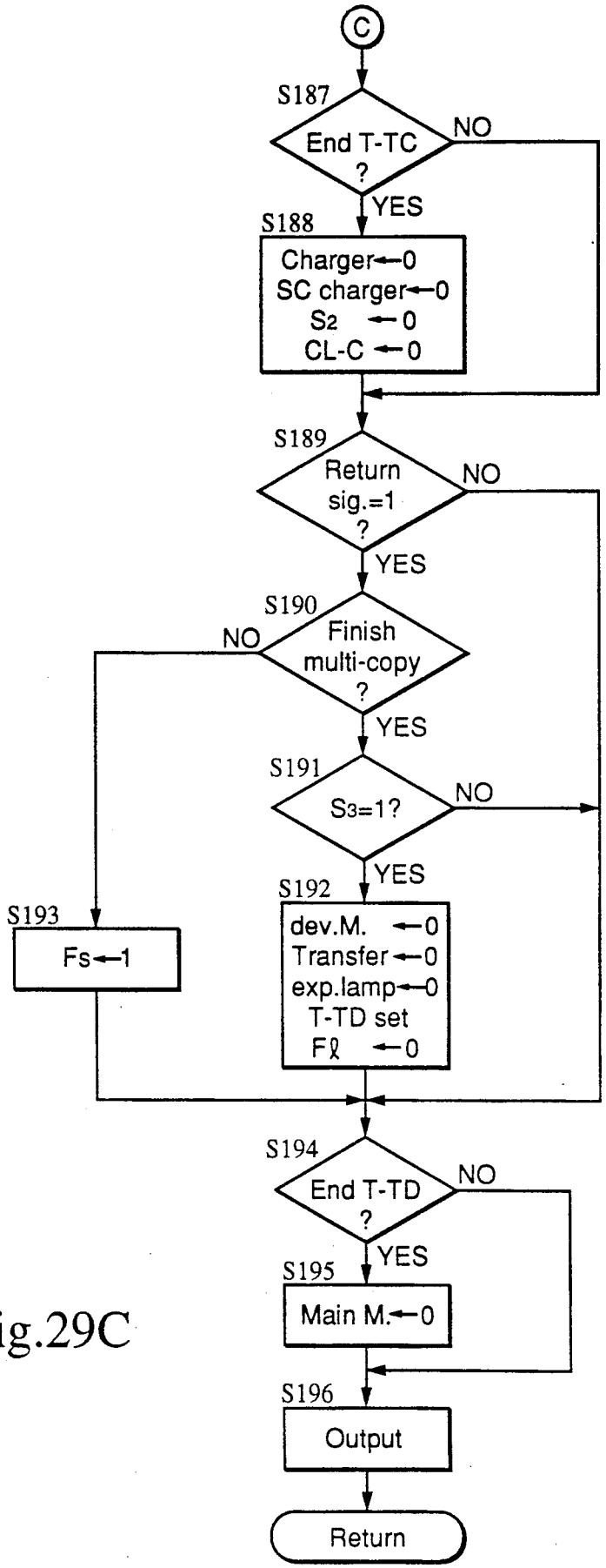

FIGS. 29*a*, 29*b* and 29*c* show the copy function routines executed in step S105 of the main routine.

First, in step S160, a determination is made as to whether or not the print key 101 is on edge, and if so, it is further determined in step S161 whether or not the ADF 200 has been selected. If the ADF 200 is not being used, the copy start flag Fs is set to "1" in step S162. If the ADF 200 is being used, a determination is made in step S163 as to whether or not a document is disposed upon the ADF tray 203 by means of the ON/OFF status of empty sensor ES. If the presence of a document is detected, the ADF start signal is set to "1" in step S164.

On the other hand, when the print key 101 is found to be off edge in the aforesaid step S160, a determination is made in step S165 as to whether or not use of the ADF 200 is selected. If use of the ADF 200 is selected, then in step S166 it is verified that the document fixed position signal S1 is "1," since said signal S1 is for displaying that a document is set at the specified position on glass platen 20, the copy start flag Fs is set to "1" in step S167, and the document fixed position signal S1 is reset to "0" in step S168.

Subsequently, in step S169, a determination is made as to whether or not the band forming flag Fb registers "1." Remember that when the bind mode is selected, the band forming flag Fb is set to "1" in step S164. Therefore, if said flag Fb is reset to "0," the routine progresses to step S172, while if said flag Fb is set at "1," a determination is made in step S170 as to whether or not the last document sheet flag Fl registers "1." The last document feed flag Fl is set to "1" when the last document sheet, i.e., the first page of the document stack, is fed from document tray 203 (refer to steps S237 and S238). Accordingly, if the last document feed flag Fl is reset to "0," the routine progresses to step S172, while if said flag Fl is set at "1," the band forming flag Fb is reset to "0" in step S171, and the bind mode copy function is terminated.

Next, in step S172, a check is made to determine if the copy start flag Fs registers "1." If said flag Fs is set at "1," the main motor, developing motor, charger, transfer charger, and exposure lamp are switched ON in step S173, the copy start flag Fs is reset to "0," and timers T-TA and T-TB are set. The routine continues and when the band forming flag Fb is found set at "1" in step S174, the scorotron charger is turned ON in step S175 and the electrostatic latent image used for binding toner developing is formed. In steps S176 and S178, a determination is made as to whether the top feed cassette 40 or the bottom feed cassette 43 has been selected, and in steps S177 and S179 the selected feed roller clutch is switched ON.

Subsequently, when the judge-end timing of timer T-TA is verified in step S180, the top and bottom feed roller clutches are turned OFF in step S181. Further, when the judge-end timing of timer T-TB is verified in step S182, the scan signal is set to "1" in step S183, and the optical unit 30 begins to move while at the same time in step S184 the timing signal control timer T-TE is set to a fixed time. When the judge-end time of timer T-TE is verified in step S185, the timing roller clutch CL-C is turned ON and the timer T-TC is set in step S186.

When the judge-end time of timer T-TC is verified in step S187, then in step S188 the charger, scorotron charger, timing roller clutch CL-C is switched OFF and the scan signal is reset to "0." The routine continues and when it is determined in step S189 that the return signal is set at "1," a check is run in step S190 to determine if the multiple copy function has ended, and if said multiple copy function has not ended, the copy start flag Fs is set to "1" in step S193. If the multiple copy function is found to have ended, the set position signal S3 is checked to see if it registers "1" in step S191. This set position signal S3 is set at "1" when optical unit 30 returns to the home position and the set position switch is turned ON. Accordingly, if the set position signal S3 is set at "1," then in step S192 the developing motor, transfer charger and exposure lamp are switched OFF, timer T-TD is set, and the last document feed flag is reset to "0." Then, when the judge-end time of timer T-TD is verified in step S194, the main motor is tuned OFF in step S195, and the results of current processing are output in step S196.

Figure 30:
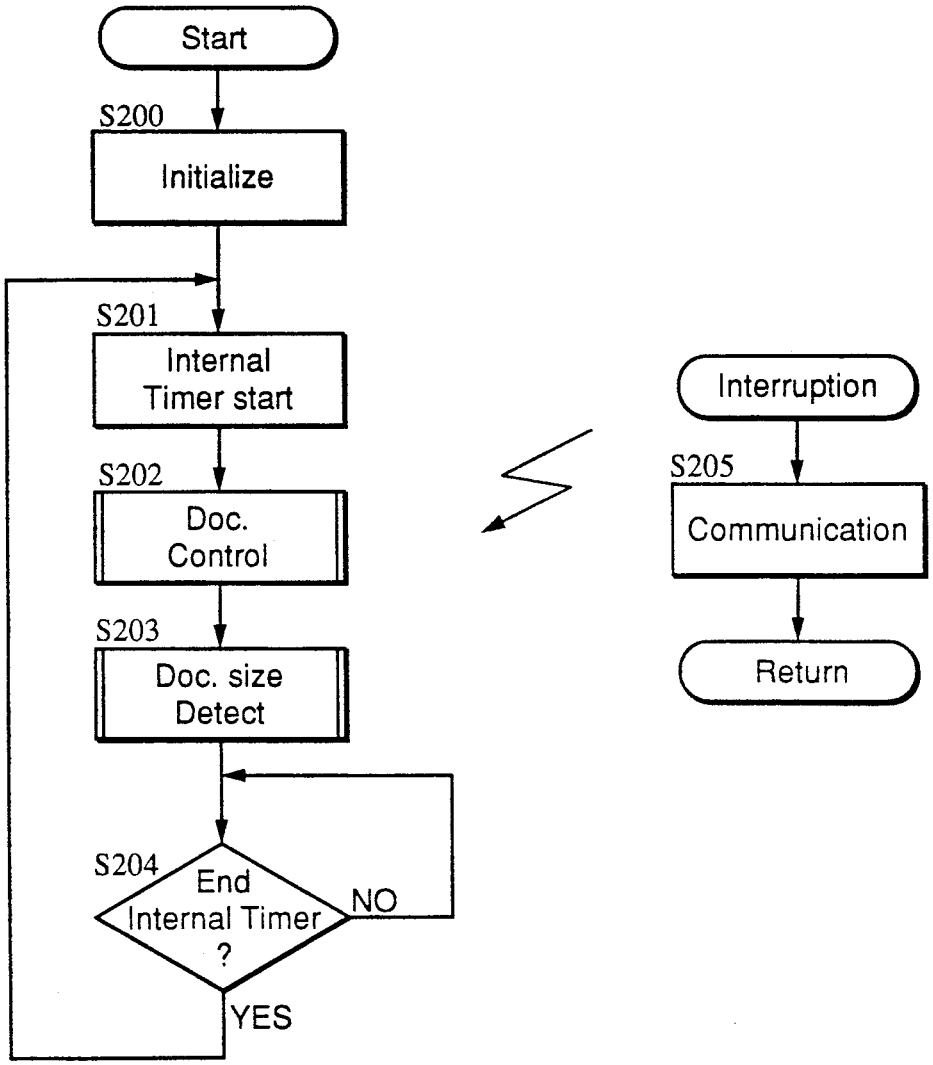

FIG. 30 shows the main routine of the third microcomputer CPU3 which controls the ADF 200.

When the CPU3 is reset and the program starts, initialization is executed in step S200 to clear the random access memory (RAM), initialize each register and set the initialization mode for each device. Then, the internal timer provided in CPU3 is started in step S201. The internal timer determines the specific time required to run the main routine, and its predetermined value is set at initialization in step S200.

Next, in steps S202 and S203, each subroutine is called in sequence, and when all subroutines have been processed, in step S204 the completion of the aforesaid internal timer is awaited and one routine ends. Various timers used in each of the subroutines count using the length of time required to complete the aforesaid one routine. That is, all counters in each of the subroutines count by counting the number of times the one routine runs so as to determine when said timer cycle ends.

Meanwhile, data communication with microcomputer CPU1 implements the interrupt routine in step S205 by means of an interrupt request from CPU1 and without connection with the main routine.

Figure 31:
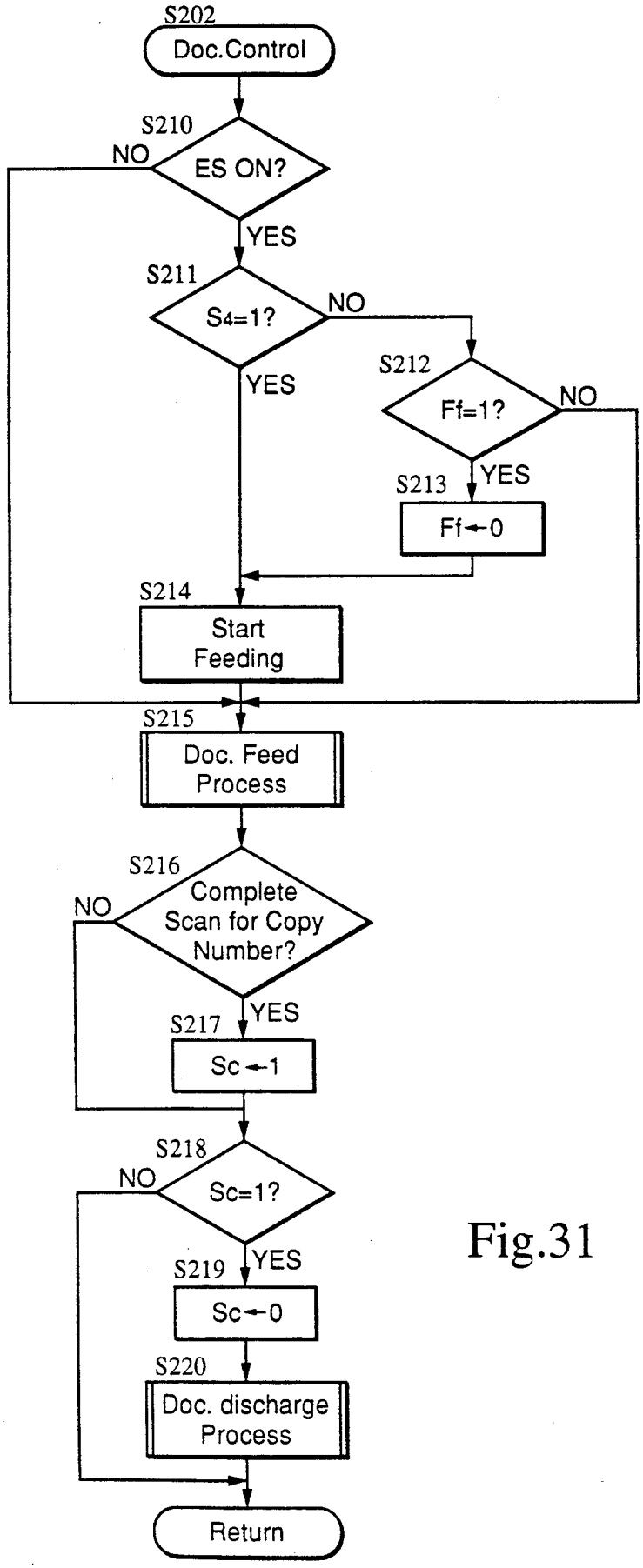

FIG. 31 shows the document control routine executed in step S202 of the main routine.

In step S210 it is determined whether or not a document is placed on the document tray 203 based on the ON/OFF status of sensor ES. If the sensor ES is ON, a determination is made in step S211 as to whether or not the ADF start signal S4 from CPU1 registers "1." If the result of the inquiry is YES, the routine continues to step S214, and if the reply is NO, then in step S212 the document feed flag Ff is checked to see if it registers "1," and if so, said flag Ff is reset to "0" in step S213. The document feed flag Ff is the flag for automatically feeding the second and subsequent sheets of the document stack from the document feed portion 201 (refer to steps S250 and S251).

Then, in step S214, the transport belt motor is turned ON, document feed motor is turned ON, and in step S215 the document feed process routine is executed. In step S216 a determination is made as to whether or not the predetermined copy number scan is completed, and if not completed, a check is made in step S218 to see if the scan-end flag Fc registers "1." If the copy number scan has been completed, the scanend flag Fc is set to "1" in step S217. When it is found in step S218 that the scan-end flag Fc registers "1," said flag Fc is reset to "0" in step S219, and the document discharge process routine is executed in step S220.

Figure 32:
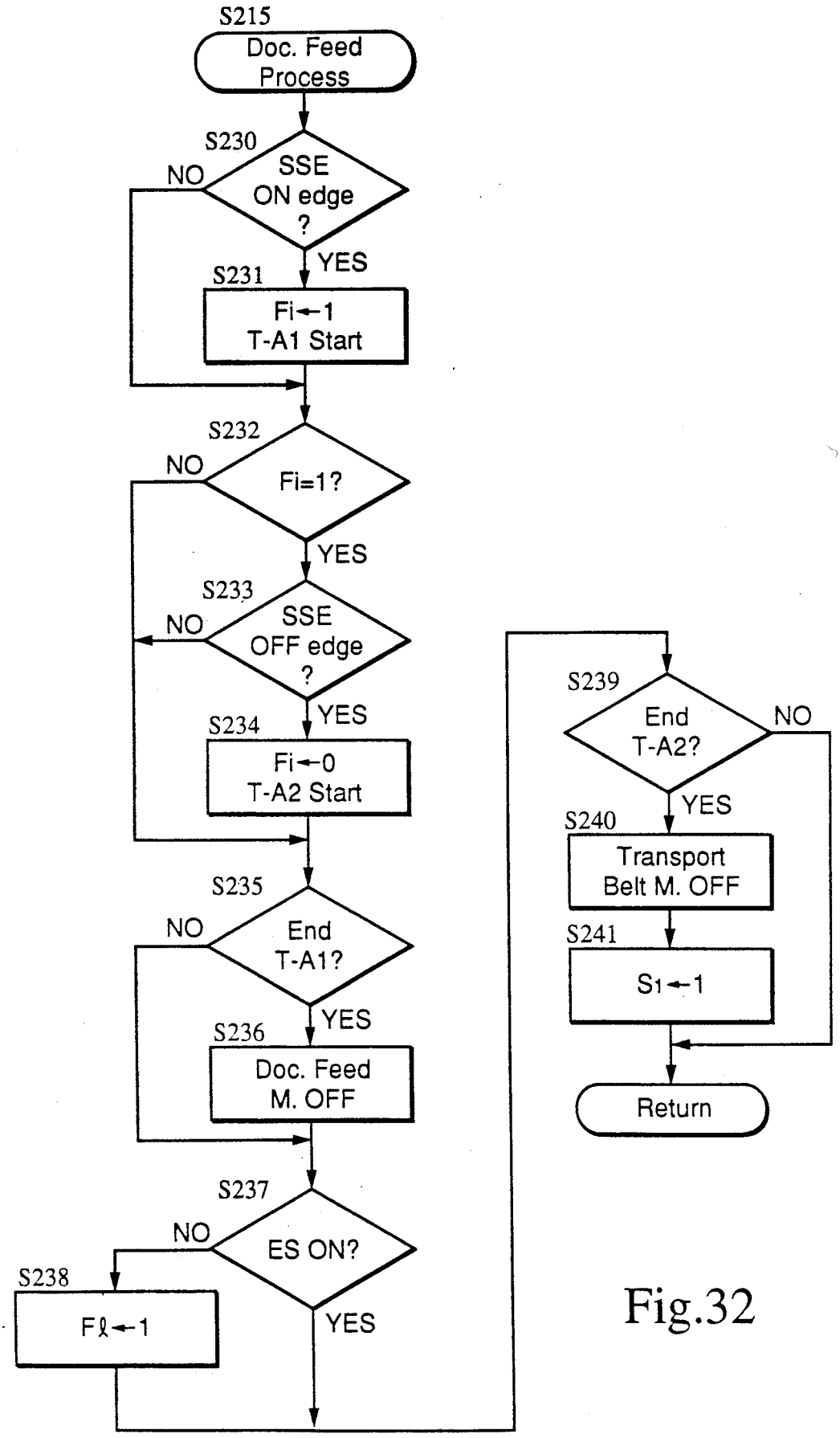

FIG. 32 shows the document feed process routine implemented in step S215 of the main routine.

When it is determined in step S230 that the document size sensor SSE is on edge, in step S231 the size detecting flag Fi is set to "1" and the timer T-A1 is started. Timer T-A1 provides the timing for switching OFF the document feed motor, and is set for the time required for the document to be advanced to a position from which it can be transported by transport belt 206. This arrangement avoids the disadvantage of having the document feed motor continue to run during the time after a first document feed is completed until a second document feed begins.

When the size detecting flag Fi is found to register "1" in step S232, a check is made in step S233 to discover whether or not the sensor SSE is on edge. If said sensor SSE is on edge, i.e., when the sensor SSE detects passage of the trailing edge of the document, then in step S234 the size detecting flag Fi is reset to "0" and timer T-A2 is started. Timer T-A2 is set for the time required for the trailing edge of the document to reach the document leading edge position on the glass platen 20. Then, when the end of timer T-A1 is verified in step S235, the document feed motor is switched OFF in step S236, and a determination is made as to whether or not a document sheet remains on document tray 203 by checking the ON/OFF status of sensor ES in step S237. If sensor ES is OFF, no document sheets remain, and the last document sheet feed flag Fl is reset to "1" in step S238 because the last sheet to be fed was the last document sheet (first page of the document). At this time, the binding mode is terminated for the last document sheet since it is actually the first page of the document, and normal copy function is implemented (refer to steps S170 and S171).

Subsequently, when the completion of timer T-A2 is verified in step S239, the transport belt motor is turned OFF in step S240, and in step S241 the document position signal S1 is set to "1" and transmitted to CPU1.

Figure 33:
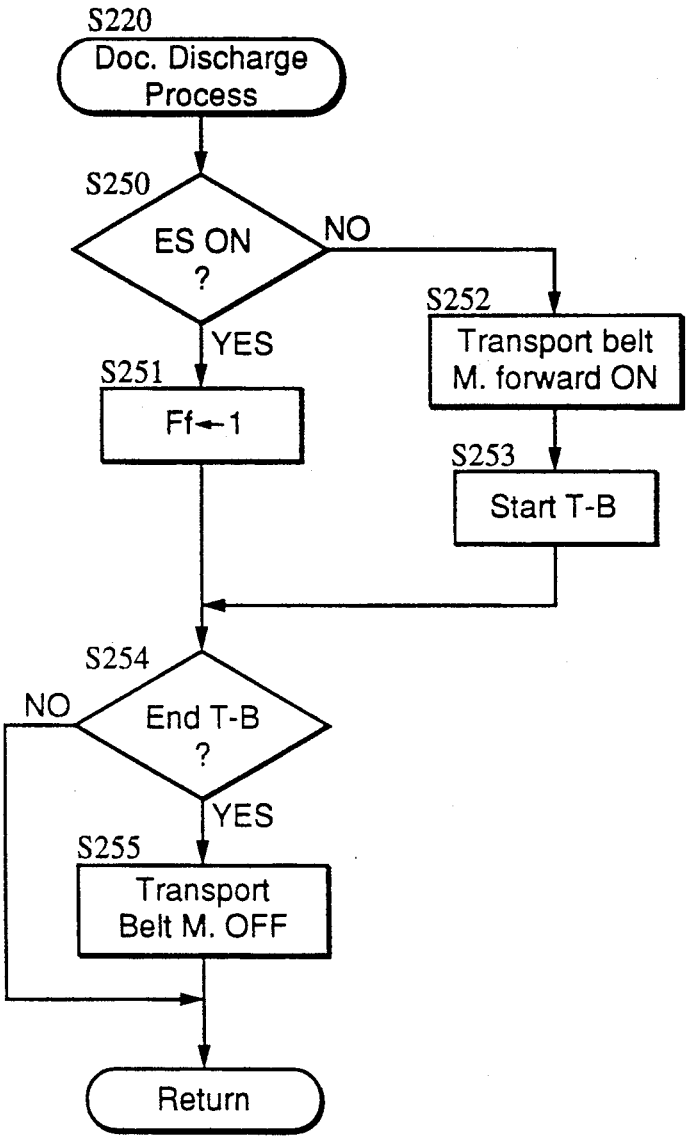

FIG. 33 shows the document discharge process routine executed in the aforesaid step S220.

A check is made in step S250 by means of the ON/OFF status of document empty sensor ES, to determine whether or not a document has been placed in document tray 203. When a document is found to remain in said tray 203, the document feed flag is set to "1" in step S251. When no document remains in tray 203, the transport belt motor is forwardly rotated in step S252, and timer T-B is started in step S253. Timer T-B is set for the time required to discharge a document of maximum dimensions from glass platen 20. Then, the completion of timer T-B is verified in step S254, the transport belt is switched OFF in step S255 and the subroutine ends.

Figure 34:
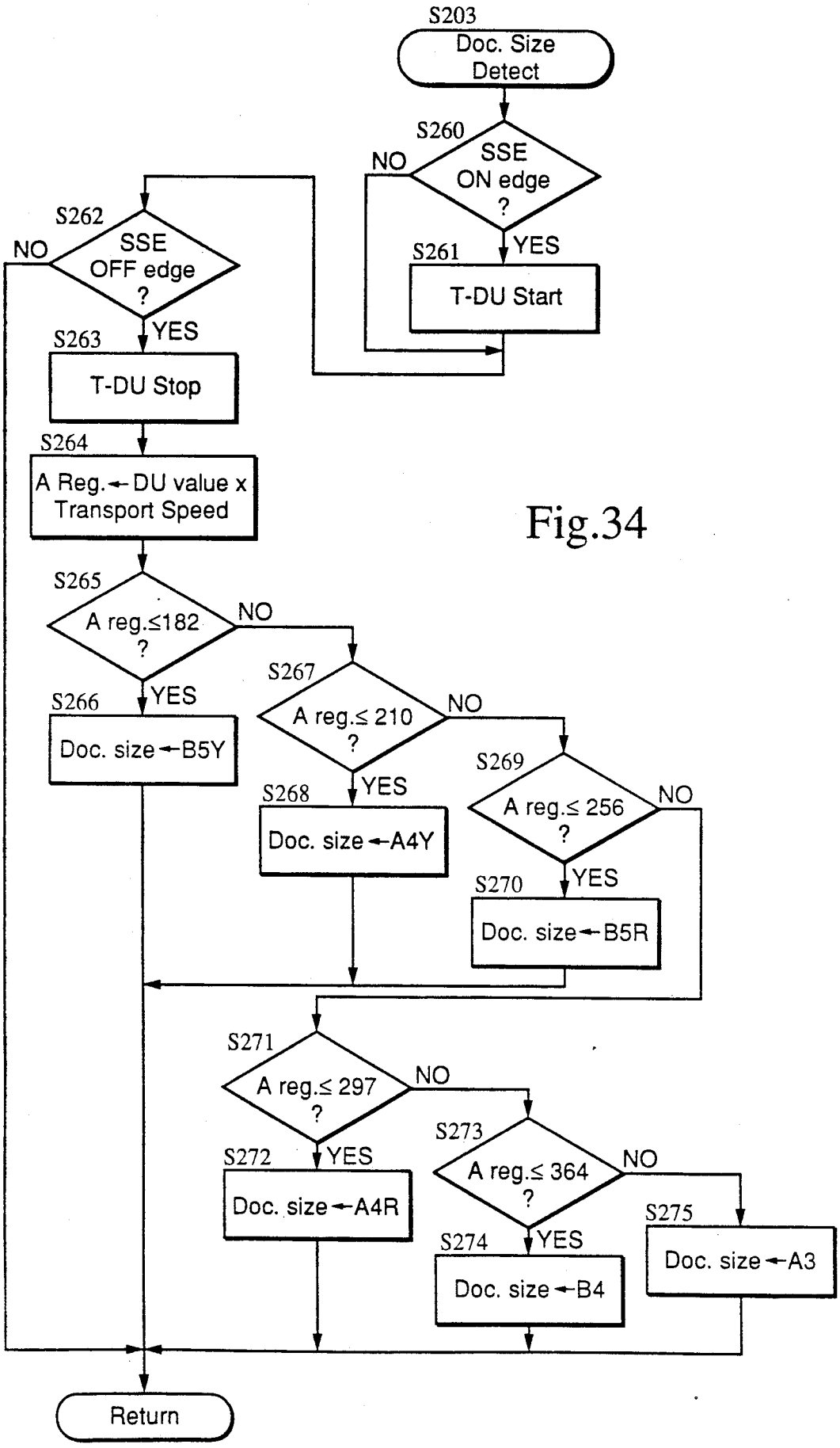

FIG. 34 shows the document size detecting routine executed in step S203 of the main routine.

First, when it is determined in step S260 that the document size sensor SSE is on edge, the timer T-DU is started in step S261. Then, when the document size sensor SSE is detected in step S262 to be off edge, i.e., when sensor SSE detects the passage of the trailing edge of the document, the timer T-DU is stopped in step S263, and in step S264 the value of timer T-DU multiplied by the document transport speed, i.e., the document length, is stored in the A-register.

Thereafter, in step S265 to S270, document size is determined by the value stored in the A-register. For example, when the value stored in the A-register is found to be $\leqq$ 182, the document size is determined to be B5 landscape (horizontal) (B5Y), and the determination is made in the same manner in steps S267, S269, S271 and S273.

An explanation follows for the control of the second mode, i.e., the previously described second operation mode wherein the final sheet of the document stack (first page of the document) is copied with binding toner deposited on the copy paper and a separate cover sheet is used which is not subjected to the image process or binding toner deposition.

The present control sequence is substantially the same as that for the first mode shown in FIGS. 25 through 34, and differs only in that a portion of the copy function routine of step S105, and a portion of the document feed process routine of step S215 are changed, and a cover sheet discharge routine has been added to a new step S168*b*. The explanation provided herein thus concerns only the aforesaid points of departure.

Figure 35A:
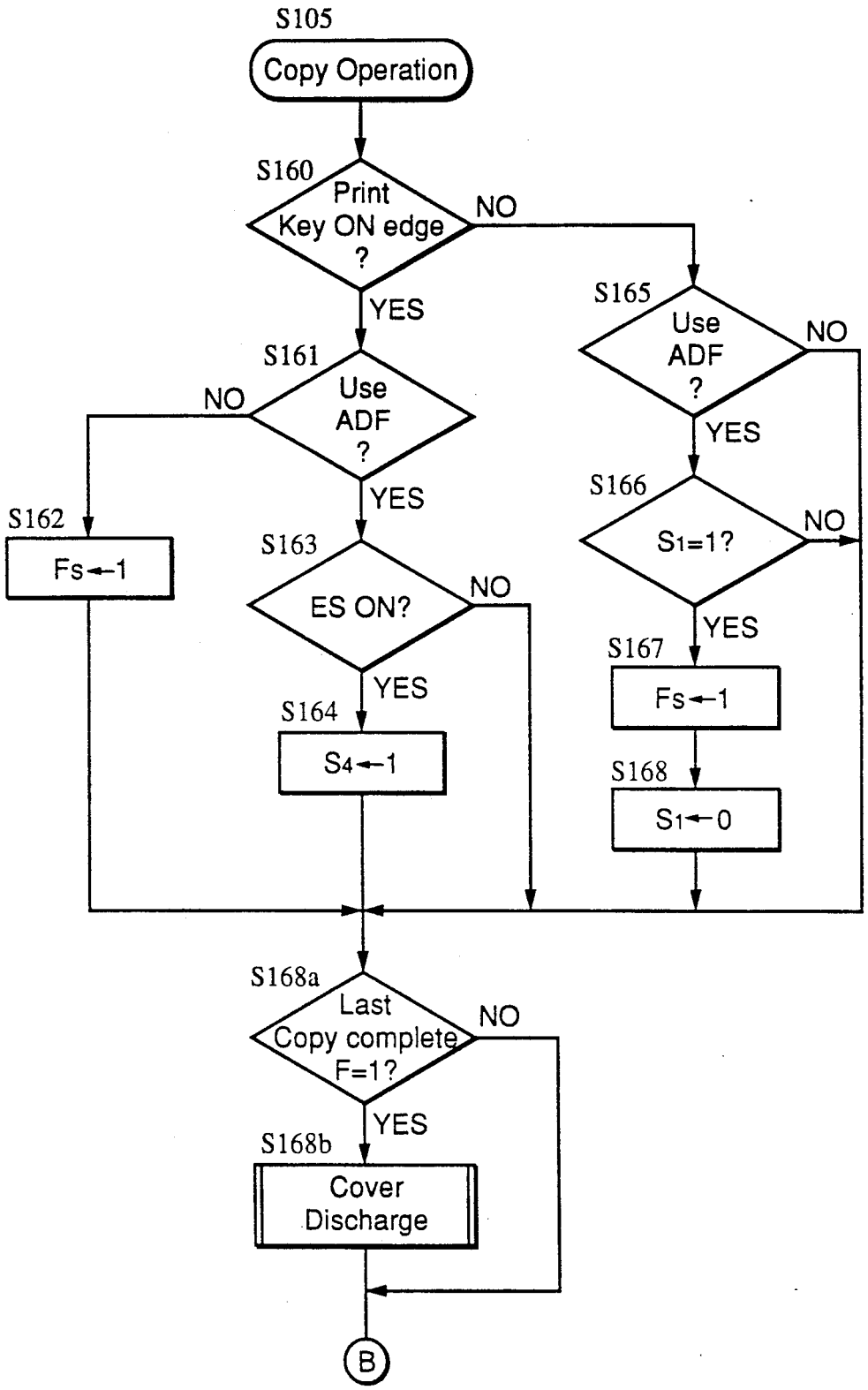
Figure 35B:
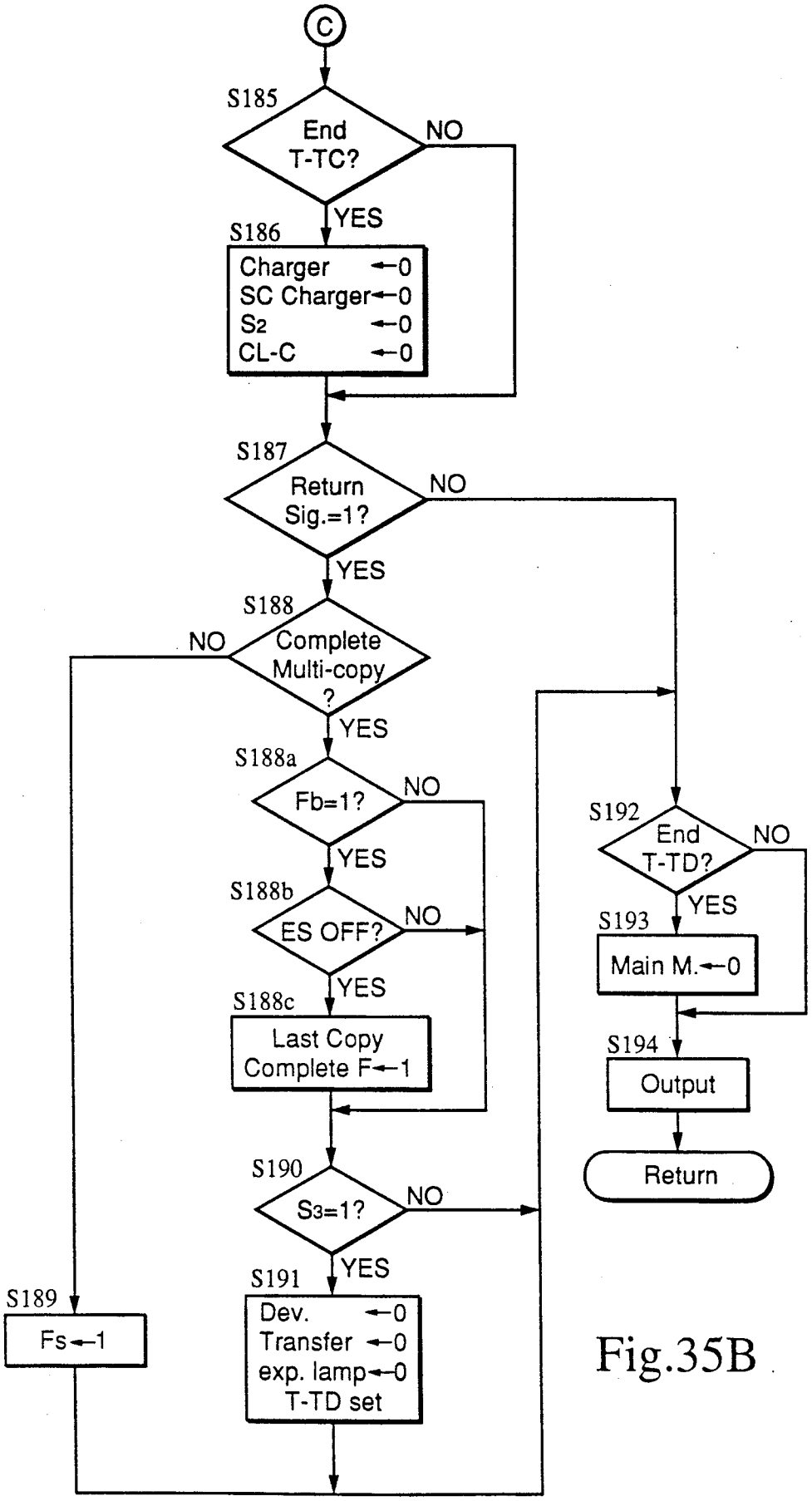

In the copy function routine shown in FIGS. 35*a* and 35*b*, after the preparation process for feeding the documents is implemented in steps S160 to S168, a determination is made in step S168*a* as to whether or not the last copy-end flag registers "1." When the last copy-end flag is set at "1," the last sheet of the document stack (first page of the document) is fed, and the end of the copy function is displayed (refer to steps S188*a*, S188*b* and S188*c*). Accordingly, if the aforesaid flag is set at "1," the display discharge routine is executed in step S168*b*.

After the steps S172, to S174 shown in FIG. 29*b* and steps S185 to S187 shown in FIG. 35*b*, when the end of the multiple copy function is verified in step S188, and the band forming flag Fb is set to "1" in step S188*a*, i.e. when the bind mode is selected, then a determination is made in step S188*b* as to whether or not a document sheet remains in document tray 203 by means of the ON/OFF status of empty sensor ES. When all document sheets are fed and sensor ES is OFF, the last copy-end flag is set to "1" in step S188*c*, and execution of the cover discharge routine is assigned. Processing to implement copy-end are performed in subsequent steps S190 through S194.

Figure 36:
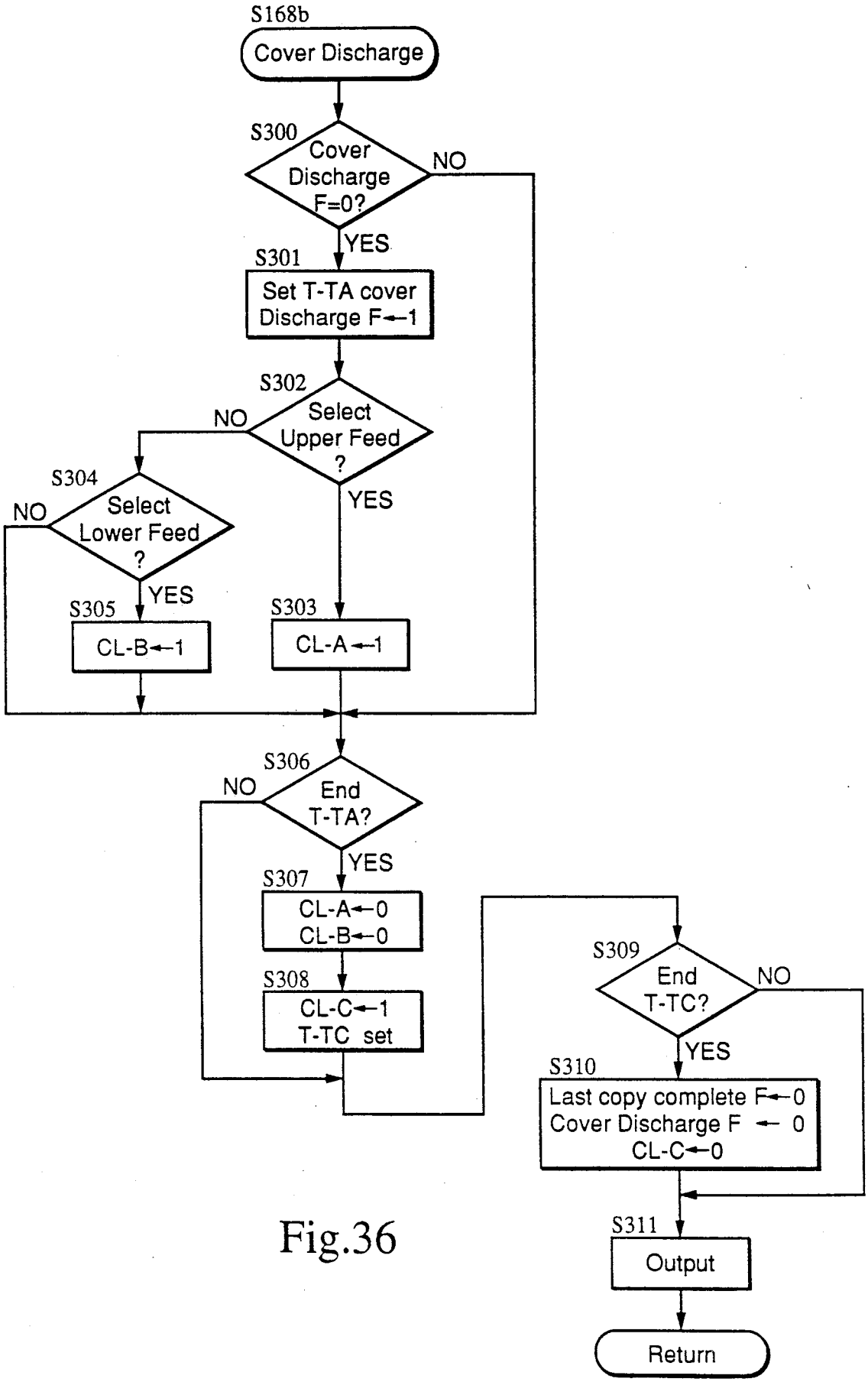

FIG. 36 shows the cover discharge routine executed in step S168*b*. In this routine, following completion of the last document copy function, a sheet of the same type paper is transported as the cover sheet to the transfer portion without being subjected to a copy operation, and thereafter discharged to the sheet binding device 70.

First, a check is made to determine whether or not the cover discharge flag registers "0" in step S300. This cover discharge flag is used to execute the cover feed process, and when said flag registers "1," the routine advances to step S306, while if said flag is reset to "0," in step S301, the timer T-TA is started and cover discharge flag is set to "1." Next, in steps S302 and S304 it is determined which cassette 40 or 43 should feed the copy paper, and the feed roller clutch for the selected cassette is switched ON in steps S303 and S305, and the cover sheet is thereby fed to the system.

Subsequently, when the judge-end timing of timer T-TA is verified, the feed roller clutch is turned OFF in step S307, and in step S308 the timing roller clutch CL-C is switched ON and timer T-TC is started. Although at this point the display indicates the sheet has advanced to the transfer portion, the transfer charger and other image forming elements are not actuated, and only the cover sheet is transported. When the judge-end timing of timer T-TC is verified in step S309, then in step S310 the last copy-end flag and cover discharge flag are reset to "0" and the timing roller clutch is switched OFF, and in step S311 the results of current processing are output and the subroutine is completed.

In the second mode, the document feed process routine S215 is substantially the same as the control sequence shown in FIG. 32, except that determinations about whether or not the last document sheet has been fed in steps S237 and S238. (In the second mode, this processing is accomplished in steps S188*b* and S188*c*.)

In this embodiment, the width of the band of toner deposited on one side of the sheet is adjustable. More specifically, by displacing the position of the scorotron charger 400 somewhat to the outside of the normal position, the toner deposition width can be narrowed to about 50% of normal. If the band is narrowed in this manner, the adhesion during binding is reduced, but this method is effective at providing a temporary binding from which pages can be separated as required thereafter.

Additionally, toner may be deposited in a striped pattern by intermittent ON/OFF switching of the scorotron charger 400.

Also, the scorotron charger 400 may be displaced to the center so as to form a region of high electric potential in the center of the photoreceptor drum, thereby allowing the sheets to be bound in the center.

The above explanations deal entirely with the formation of a positive latent image and normal developing wherein a high electric potential portion has deposited thereon a toner having the opposite polarity to the charge polarity.

However, in an image forming device that forms a negative latent image by removing the charge from the image portion and uses reverse developing by adhering a toner having the same charge polarity as that of the low electric potential portion, the scorotron charger 400 may be provided a function to remove the charge from the binding toner deposit portion.

On the other hand, if the sheet binding device 70 uses a face down discharge method, the image bearing copies are discharged face down from the first page. Accordingly, in such a case, in the operation mode which corresponds to the first mode, the first copy sheet (first page of the document) is discharged without binding toner, while binding toner is deposited on subsequent sheets which correspond to the second page and so on to the end of the document. In the operation mode corresponding to the second mode, the cover sheet is discharged before the copy process is applied to the document stack.

In the ADF 200, the detecting means for detecting the last document sheet need not necessarily be the empty sensor ES. For example, if a means for inputting the number of document sheets beforehand is provided, detecting the document sheets can be accomplished by comparison with the document feed number. In the present invention, furthermore, the ADF is not necessarily required. A construction for inputting the cover sheet to CPU1 by a variety of input means may be used even when a manual document exchange method is used.

In the present embodiment, toner waste and consumption are reduced, a clear finish is produced, and there is not apprehension that the fixing portion of the sheet binding means will be soiled by toner due to the provided control which can prevent binding toner form being deposited on the sheet.

Fourth Embodiment

Figure 37:
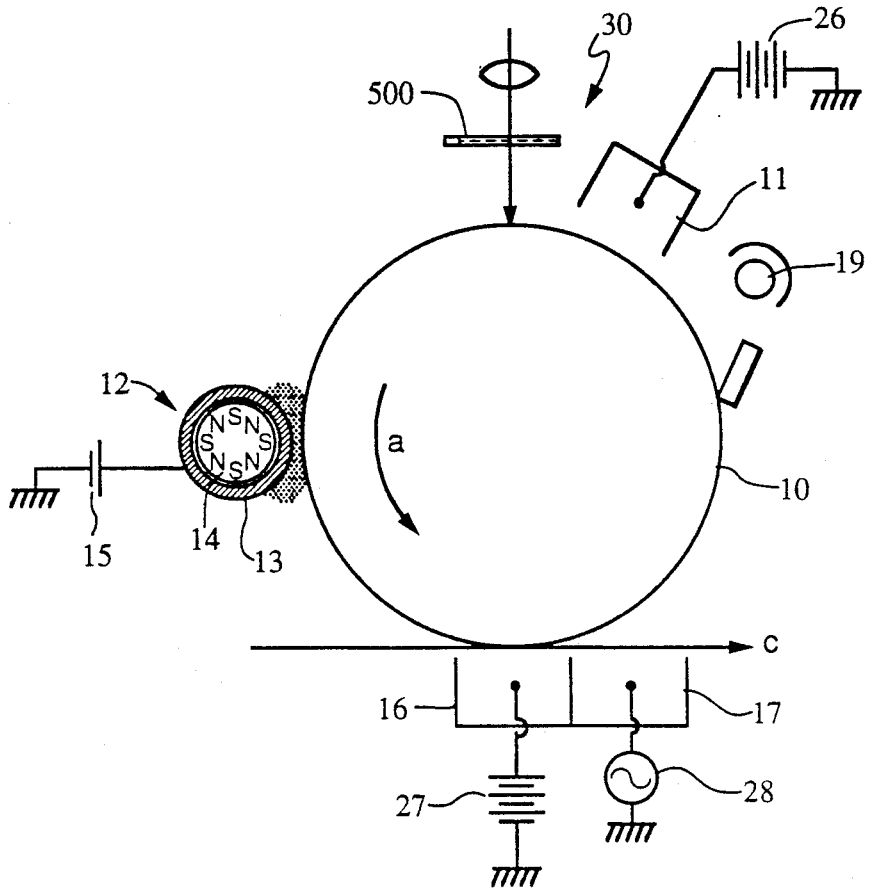
FIG. 37 is a brief structural view of the fourth embodiment of the image forming means.

The copy machine using the present invention is substantially the same as that shown in FIG. 20, with the exception that, in place of the scorotron charger 400, a liquid crystal shutter 500 is provided to the last portion of the optical unit 30 (See FIG. 37).

The liquid crystal shutter is provided a plurality of individual elements arranged in a row(s) corresponding to the width of an exposure slit in the axial direction of the photoreceptor drum 10, each element normally allowing light to pass therethrough when in the state wherein voltage is OFF, and blocking the passage of light when in the ON state. In the present embodiment, a band of toner T is deposited on one side of the sheet P parallel to the transport direction j, as shown in FIG. 24. Due to this arrangement, the liquid crystal shutter 500 switches ON the elements in the portion corresponding to the width of the band of binding toner T, thereby blocking the transmittance of light at said band portion. Thus, the band remains as a region of high electric potential at one edge of photoreceptor drum 10 while charger 11 applies a charge to said drum.

In the present embodiment, on the other hand, the sheet is transported based on the center portion in the width direction of the transport path. Accordingly, a charge must remain at a specific location in order to deposit the binding toner T in a band which is in accord with the size of the sheet. The liquid crystal shutter 500 therefore is controlled so as to switch ON and OFF individual elements corresponding with the paper size.

In addition, the width of the toner band deposited on one side of the sheet is adjustable. More specifically, the width of the toner deposit may be narrowed to about 50% of normal by narrowing the number of elements of liquid crystal shutter 500 which are switched ON in the width direction. If the band is narrowed in this manner, the adhesion during binding is reduced, but this method is effective at providing a temporary binding from which pages can be separated as required thereafter.

Also, toner may be deposited in a striped pattern by intermittent ON/OFF switching of said liquid crystal shutter 500.

The toner band may be formed on the leading edge or the trailing edge in the transport direction, as shown in FIG. 12*a*. In either case, the liquid crystal shutter 500 is arranged traversely to the axial direction of photoreceptor drum 10 and switches ON and OFF synchronously with the latent image formation timing as the sheet passes thereby, so as to form high electric potential region for binding toner deposition in the axial direction of photoreceptor drum 10. In this case, liquid crystal shutter 500 controls the individual elements so as to be turned ON and OFF alternately within a fixed space in the axial direction of photoreceptor drum 10, to allow the binding toner to be deposited in a striped pattern as previously described. When thus binding the the leading edge of the sheet stack, a pair of heat roller 78 are used as heating means in sheet binding device 70, as shown in FIG. 1.

In addition, if the elements in the center of liquid crystal shutter 500 are switched ON, binding toner can be deposited to the center portion of photoreceptor drum 10 in the axial direction, thereby binding said sheet stack in the center.

Alternatively, the position at which liquid crystal shutter 500 is provided need not be a position adjacent to photoreceptor drum 10, but may be a selectably optional position in the near the center of the exposure optical path of lens 35.

In addition to the aforesaid liquid crystal shutter 500, a PLZT shutter or like means with individual elements which have controllable ON/OFF light transmittance may be used as the shutter means in the present embodiment.

Fifth Embodiment

Figure 38:
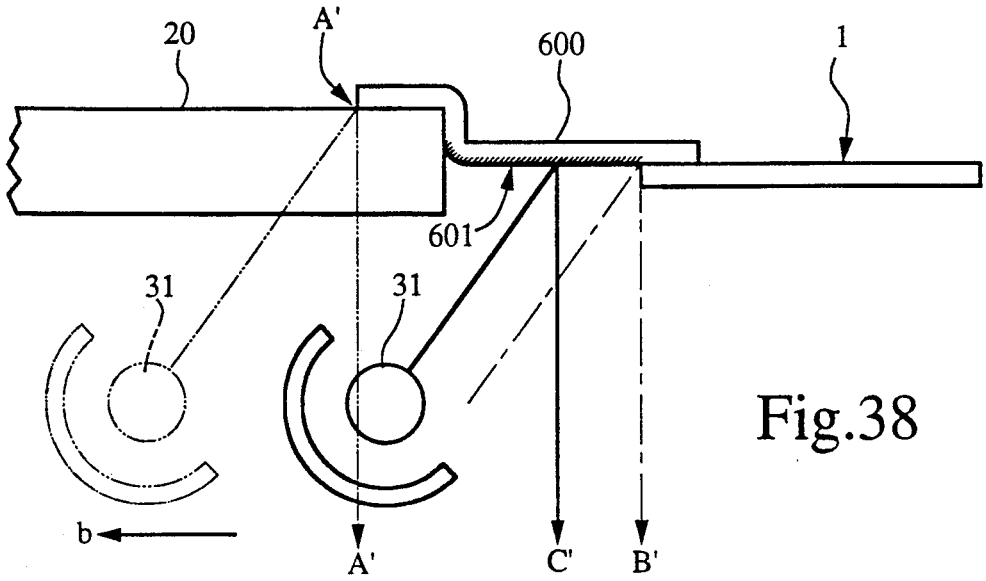
FIGS. 38, 39 and 40 show the fifth embodiment of the image forming apparatus of the present invention.

The copy machine provided with the present embodiment is substantially the same as that shown in FIG. 20, with the exception that scorotron charger 400 and the ADF 200 are omitted and the construction of the document glass platen 20 is modified in the present embodiment. More specifically, in the present copy machine, a document scale 600 is provided at one edge of document glass platen 20, as shown in FIG. 38. The rear side of the document scale 600 is provided a nonreflective process portion (for example, a black coating) along the entire length of the scale at portion 601 indicated by the slanted lines in the drawing. The original document (not shown) is placed on the document glass platen 20 aligned at the edge A' of the document scale 600, and image exposure begins from said edge A' with the displacement of the exposure lamp 31 in the direction of arrow b.

Exposure lamp 31 starts to move from the home position slightly to the right of the solid line in FIG. 38, and although the exposure light is projected onto the nonreflective process portion 601 in the stage of preliminary movement toward image exposure position A', said exposure light does not reach the surface of photoreceptor drum 10 at this time, such that the surface potential of photoreceptor drum 10 remains as a region of high electric potential while charger 11 imparts a charge thereto. Accordingly, toner adheres to this region of high electric potential as it passes the developing device 12. During normal copy function, however, the toner deposited on the surface of the photoreceptor drum in the portion corresponding to the nonreflective process portion 601 is not transferred because the previously mentioned timing roller set 45 are driven with a timing which conforms the leading edge of the sheet with the image exposure start position A', and transfers said sheet to the transfer portion.

When the sheet binding process is underway, on the other hand, the timing of the aforesaid timing roller set 45 is controlled so as to be faster than during the normal copy function. That is, the said timing is speeded up only for a time which corresponds to the distance the exposure lamp 31 is displaced from point B' to point A' in FIG. 38. By means of this control the leading edge of the sheet quickly reaches the transfer portion, and the toner deposited on the surface of photoreceptor drum 10 in a band which corresponds to the nonreflective process portion 601 is transferred to the leading edge of the sheet.

FIG. 12*a* shows the state wherein the binding toner T is deposited on the leading edge portion of sheet P in the transport direction j. The width of this toner deposit is normally 10 mm, and this type of binding is designated permanent binding. However, in permanent binding, random sheets are difficult to separate after the binding process is performed. If the width of the binding toner T deposit is narrowed to about 50% of normal, the adhesive force during binding is reduced, but this method is effective at providing a temporary binding from which pages can be separated as required thereafter.

In the present embodiment, the timing roller set 45 is moveable based on the timing during which exposure lamp 31 projects light to the intermediate portion C' of nonreflective process portion 601. By means of such control the width of the binding toner T deposited on the leading edge of sheet P can be narrowed to produce a temporary binding.

The control panel is substantially the same as that shown in FIG. 13, with the exception that provided in the present embodiment are a permanent bind mode selection key 115 for producing a wide binding toner width, and a temporary bind mode selection key 116 for producing a narrow binding toner width.

Control Sequence

The explanation of the main routine which is identical with that shown in FIG. 25 will be omitted here.

Figure 40:
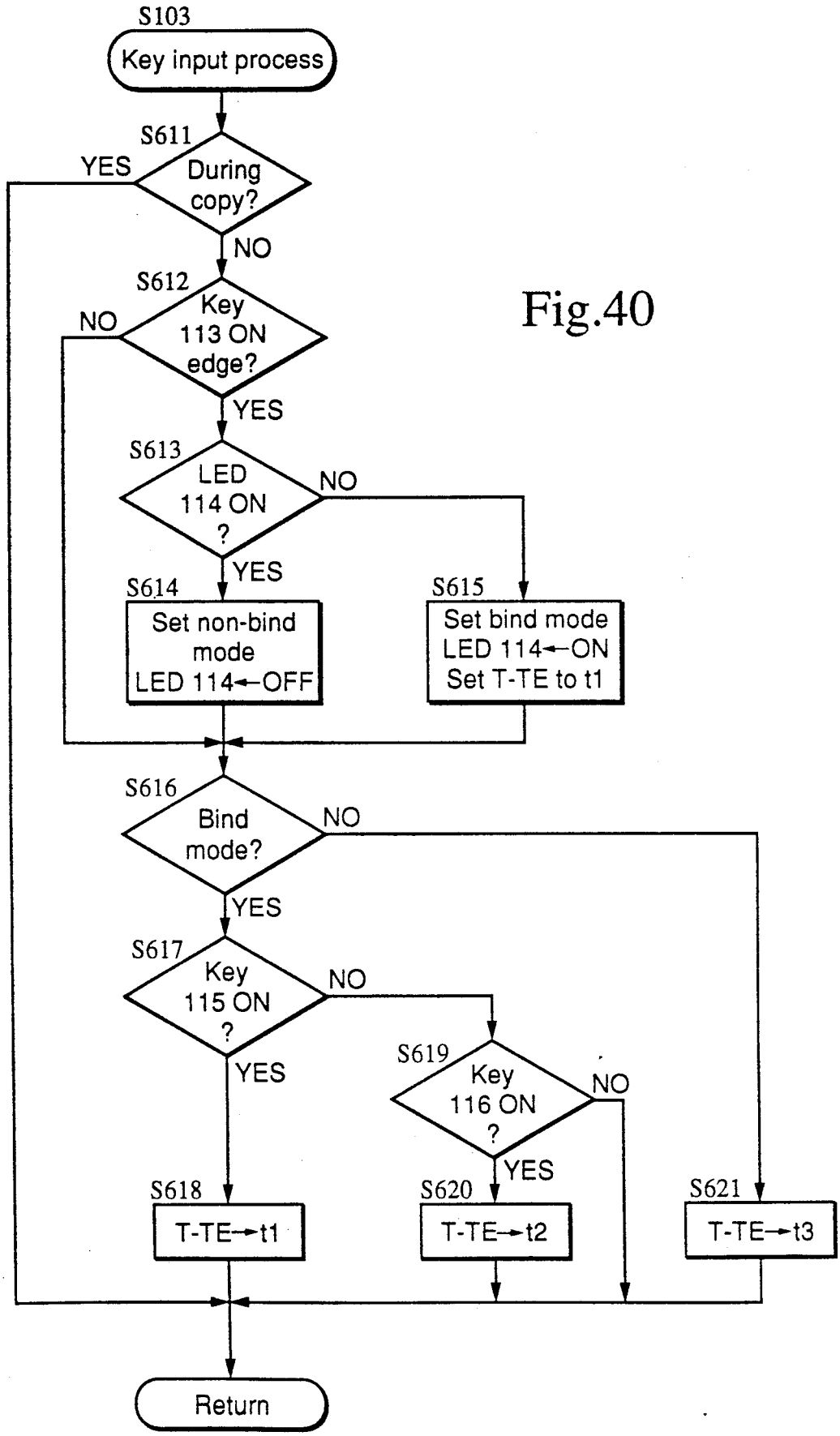

FIG. 40 shows the key input process routine executed in step S103 of the main routine.

First, it is determined in step S611 that the copy function is not in progress, and in step S612 that the bind mode selection key 113 is on edge, then a determination is made in step S613 as to whether or not the bind mode display LED 114 is switched ON. If said LED 114 is ON, it indicates a current bind mode selection is active so a cancel signal is output, and in step S614 the non-bind mode is set and LED 114 is switched OFF. In step S613, the LED 114 is found to be OFF and the bind mode selection is activated, in step S615 the bind mode is set, timer T-TE is set to time T1 and LED 114 is turned ON.

Figure 39:
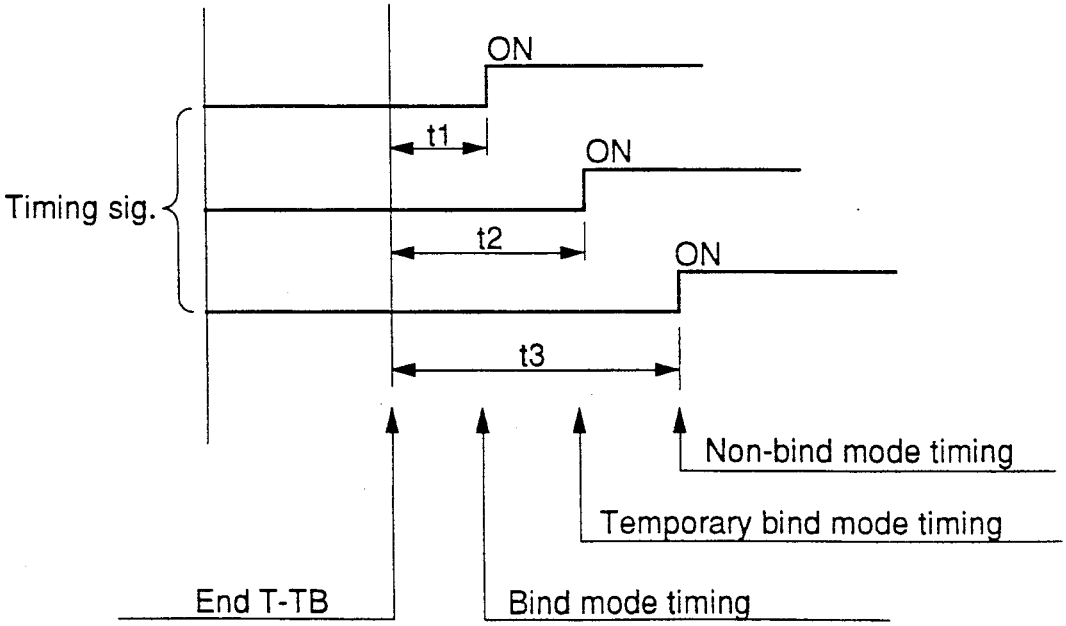

Subsequently, a determination is made in step S616 as to whether or not the bind mode is selected, and since the bind mode has been selected a determination is made in steps S617 and S619 as to whether or not permanent bind mode selection key 115 or temporary bind mode selection key 116 has been switched ON. If permanent bind mode selection key 115 is ON, timer T-TE is set to time t1 in step S618. If temporary bind mode selection key 116 is ON, the same timer T-TE is set to time t2 in step S620. Also, when it is determined in the aforesaid step S616 that the non-bind mode is selected, the same timer T-TE is set to time t3 in step 621. Timer T-TE, as explained hereinafter in the copy function subroutine, controls drive start timing of timing roller set 45 which transport the sheet to the transfer section, and is set to times t1, t2 and t3, which are set in the previously described steps S618, S620 and S621 following a fixed time from the verification that timer T-TB has ended. Time t1 controls the permanent bind mode so that the leading edge of the sheet is synchronized with point B' in FIG. 38 and transported most rapidly. Time t2 controls the temporary bind mode so that the leading edge of the sheet is synchronized with point C' in FIG. 38 and transported rapidly. Time t3 controls the normal copy mode so that the leading edge of the sheet is synchronized with the document image exposure start position A'. The relative relationships of the aforesaid times t1, t2 and t3 are shown in the time chart in FIG. 39.

The copy function routine executed in step S104 of the main routine is identical to that shown in FIGS. 29*a*, 29*b* and 29*c*, except that steps S160 to S171 are abbreviated. Timer T-TE which is used to control the aforesaid timing signal is set to a predetermined time t1, t2 or t3 in step S184. When the judge-end timing of timer T-TE is verified in step S185, then in step S186 the timing roller clutch CL-C is switched ON and timer T-TC is set. Rotational actuation of timing roller set 45 begins at this time, and the sheet is transported to the transfer portion using the timing (refer to FIG. 39) of the selected mode (normal copy mode, permanent bind mode, temporary bind mode).

If the nonreflective process portion 601 of document scale 600 is coated with a black coating in a striped pattern, toner can be deposited in a striped pattern.

Alternatively, in the image forming device of the present invention, two executable bind modes of permanent and temporary bind modes are not necessarily required, but rather only a single permanent bind mode may be provided.

Further, in order to leave some white area remaining on the sheet edge, the timing for starting actuation of timing roller set 45 may be controlled so as to be somewhat faster from point B' in FIG. 38.

Also, a heating plate, as shown in FIG. 20, capable of applying pressure to the leading edge of the sheet stack shown may be used as the binding toner fusing means in place of the heating rollers 78.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus with a binding function comprising:

an image carrier rotatable by rotating means;

means for forming an electrostatic latent image onto the image carrier;

means for forming a charged region onto the image carrier ar the margin of the electrostatic latent image and including a charger disposed at a position corresponding to the charged region in the direction perpendicular to the rotating direction of the image carrier, wherein the charger charges the image carrier in accordance with the rotation of the image carrier, thereby the charged region is formed parallel to the rotating direction of the image carrier;

means for forming toner images corresponding to the electrostatic latent image and the charged region;

means for transferring and fixing the toner images formed on the image carrier onto a sheet;

means for stacking a plurality of sheets having fixed toner images in an overlying relationship; and means for binding the stacked sheets at their margins corresponding to the charged region by fusing between adjacent sheets.

2. An image forming apparatus with a binding function as claimed in claim 1, wherein said charger is movable in the direction perpendicular to the rotating direction of the image carrier for forming a charged region onto a sheet at a predetermined position of its margin.

3. An image forming apparatus with a binding function as claimed in claim 2 wherein said charger is moved in accordance with the size of the sheet in the direction perpendicular to the rotating direction of the image carrier.

4. An image forming apparatus with a binding function comprising:

means for forming a toner image corresponding to an image of an original document by developing a charge image with an electrophotographic process, said means comprising toner band forming means for forming a small band of toner at the margin of the toner image area which is formed on an image carrier and corresponds to the original document, said toner band forming means comprising an optical shutter member provided in an optical path for projecting an optical image of the original document onto said image carrier, said optical shutter being selectably actuated, thereby imparting to said image carrier a charge area for forming said small band of toner, said optical shutter member further being divided into a plurality of small portions in the direction perpendicular to the direction of movement of said image carrier, each portion being selectably operable;

means for transferring and fixing said toner image formed on said image carrier onto a sheet together with said small band of toner; and means for binding a plurality of sheets by fusing said small band of toner of a plurality of stacked sheets.

5. An image forming apparatus with a binding function comprising:

means for forming a toner image corresponding to an image of an original document by developing a charge image with an electrophotographic process, said means comprising toner band forming means for forming a small band of toner at the margin of the toner image area which is formed on an image carrier and corresponds to the original document, said toner band forming means including a scale provided at one side of a platen glass on which the original document is placed, said scale preventing light from reaching the image carrier, whereby toner is deposited onto a portion of the image carrier corresponding to said scale to thereby form said small band of toner;

means for transferring and fixing said toner image formed on said image carrier onto a sheet together with said small band of toner; and means for binding a plurality of sheets by fusing said small band of toner of a plurality of stacked sheets.

6. An image forming apparatus with a binding function as claimed in claim 6, wherein said scale is provided so as to be retractable from said platen glass.

7. An image forming apparatus with a binding function as claimed in claim 5, wherein said scale is disposed at the back surface of said platen glass.

8. An image forming apparatus with a binding function comprising:

means for forming a toner image corresponding to an image of an original document by developing a charge image with an electrophotographic process, said means comprising toner band forming means for forming a small band of toner at the margin of the toner image area which is formed on an image carrier and corresponds to the original document, said toner band forming means including a scale provided at one side of a platen glass on which the original document is placed, said scale preventing light from reaching the image carrier, whereby toner is deposited onto a portion of the image carrier corresponding to said scale to thereby form said small band of toner;

means for transferring and fixing said toner image formed on said image carrier onto a sheet together with said small band of toner;

means for binding a plurality of sheets by fusing said small band of toner of a plurality of stacked sheets; and means for changing a timing for transporting sheets toward a transfer station, whereby the width of said small band of toner is variable.

9. An image forming apparatus with a binding function comprising:

image forming means for forming a toner image corresponding to an image of an original document by developing a charge image with an, electrophotographic process, and for forming a small band of toner at the margin of the toner image area which is formed on an image carrier and corresponds to the original document, said image forming means including means for imparting a charge area in order to form said small band of toner, a first developing device for supplying to said image carrier normal toner for forming the image of the original document, a second developing device for supplying to said image carrier special toner different from said normal toner for developing said charge area, and control means for selectably operating said first and second developing devices;

means for transferring and fixing said toner image formed on said image carrier onto a sheet together with said small band of toner; and means for binding a plurality of sheets by fusing said small band of toner of a plurality of stacked sheets.

10. An image forming apparatus with a binding function as claimed in claim 9, wherein said special toner is a color toner other than black toner.

11. An image forming apparatus with a binding function as claimed in claim 9, wherein said special toner is white toner.

12. An image forming apparatus as claimed in claim 9, wherein said special toner is a highly self-adhesive toner.

13. An image forming apparatus with a binding function as claimed in claim 9, wherein said special toner is a waste toner removed from said image carrier.

14. An image forming apparatus with a binding function as claimed in claim 13, further comprising cleaning means for removing said waste toner from said image carrier, and means for sending back the waste toner removed by said cleaning means to said second developing device.

15. An image forming apparatus with a binding function as claimed in claim 9, wherein said control means controls to execute the change-over operation of the first and second developing devices during a single image forming process.

16. An image forming apparatus with a binding function comprising:

means for forming a toner image corresponding to an image of an original document by developing a charge image with an electrophotographic process, said means comprising toner band forming means for forming a small band of toner at the margin of the toner image area which is formed on an image carrier and corresponds to the original document;

means for transferring and fixing said toner image formed on said image carrier onto a sheet together with said small band of toner:

means for binding a plurality of sheets by fusing said small band of toner of a plurality of stacked sheets; and control means for inhibiting said toner band forming means from operating so as not to form the toner band on a suitable cover sheet of the sheet stack.

17. An image forming apparatus with a binding function as claimed in claim 16, wherein said suitable cover sheet is the last sheet copied from a plurality of original documents.

* * * * *

UNITED STATES PATENT AND TRADEMARK OFFICE

CERTIFICATE OF CORRECTION

PATENT NO. : 5,014,092

DATED : May 7, 1991

INVENTOR(S) : Naoki Kubo, et al.

It is certified that error appears in the above-identified patent and that said Letters Patent is hereby corrected as shown below:

In col. 15, line 9, change "plat" to --plate--.
In col. 16, line 61, change "Width" to --width--.
In col. 23, line 28, delete "the" (second occurrence).
In col. 23, line 40, delete "the" (second occurrence).
In col. 27, line 15 (claim 6, line 2), change "6" to --5--.
In col. 27, line 49 (claim 9, line 5), after "an", detlete --,-- (comma).
In the Abstract, line 20, change "comprises" to --comprise a--.

Signed and Sealed this

Twenty-third Day of March, 1993

*Attest:*

STEPHEN G. KUNIN

*Attesting Officer*

*Acting Commissioner of Patents and Trademarks*